US005970866A

United States Patent [19]

Okawa

[11] Patent Number: 5,970,866

[45] Date of Patent: Oct. 26, 1999

[54] PRINTING MACHINE WITH SOUND REDUCING APPARATUS

[75] Inventor: Eiji Okawa, Iwanuma, Japan

[73] Assignee: Tohoku Ricoh Co., Ltd., Miyagi, Japan

[21] Appl. No.: 08/897,655

[22] Filed: Jul. 21, 1997

Related U.S. Application Data

[63] Continuation of application No. 08/451,970, May 26, 1995, abandoned.

[30] Foreign Application Priority Data

Sep. 12, 1994 [JP] Japan ..... 6-217483
Sep. 30, 1994 [JP] Japan ..... 6-237683

[51] Int. Cl.[6] ..... B41L 13/14; B41J 29/10

[52] U.S. Cl. ..... 101/118; 101/232; 400/689; 271/171

[58] Field of Search ..... 101/116–118, 128.4, 101/232; 400/689, 690, 690.3, 690.4; 271/145, 171; 181/201, 202; 312/208.2, 208.3, 223.1, 223.2

[56] References Cited

U.S. PATENT DOCUMENTS

| | | | |
|---|---|---|---|
| 3,513,938 | 5/1970 | Buehner et al. | 181/201 |
| 4,502,804 | 3/1985 | Willcox | 400/690 |
| 4,662,765 | 5/1987 | Kapp et al. | 400/595 |
| 4,733,982 | 3/1988 | Starkweather | 400/690 |
| 4,849,796 | 7/1989 | Murakami | 271/171 |
| 5,121,811 | 6/1992 | Shima et al. | 400/689 |
| 5,207,157 | 5/1993 | Okazaki et al. | 101/116 |
| 5,535,671 | 7/1996 | Kanno | 101/116 |

FOREIGN PATENT DOCUMENTS

| | | | |
|---|---|---|---|
| 252182 | 11/1986 | Japan | 400/690 |
| 62-197626 | 12/1987 | Japan . | |
| 3-93130 | 9/1991 | Japan . | |
| 5-12183 | 3/1993 | Japan . | |
| 8579 | 1/1994 | Japan | 400/689 |
| 2206537 | 1/1989 | United Kingdom | 181/201 |

*Primary Examiner*—Stephen R. Funk
*Attorney, Agent, or Firm*—Oblon, Spivak, McClelland, Maier & Neustadt, P.C.

[57] ABSTRACT

A printing machine comprising a sheet feeding station for feeding sheets into a printing station and capable of being detachably attached into a sheet inlet, a sheet discharging station for discharging printed sheets from the printing station and positioned near a sheet outlet, and a cover disposed near at least the sheet inlet or the sheet outlet and shielding either the sheet inlet or sheet outlet except for at a sheet passing area thereof.

8 Claims, 24 Drawing Sheets

PRINTING MACHINE WITH SOUND REDUCING APPARATUS

This application is a Continuation of application Ser. No. 08/451,970, filed on May 26, 1995, now abandoned.

BACKGROUND OF THE INVENTION

1. Field of the Invention

This invention relates to a printing machine, and more particularly to a sound reducing apparatus for the printing machine.

2. Description of the Prior Art

Printers, copying machines, facsimile machines and so on are currently available as print producing machines.

Such a print producing machine includes a sheet inlet for feeding sheets thereinto and a sheet outlet for discharging printed sheets.

A sheet tray is disposed near the sheet inlet while a printed sheet tray is positioned near the sheet outlet.

Sheets are fed into the printing machine from the sheet tray via the sheet inlet, are printed, and are discharged via the sheet outlet onto the printed sheet tray. The sheet inlet and outlet are relatively large such that a maximum amount of sheets can be fed and discharged via them.

The printing machine also includes a number of devices such as motors, and units operated by the motors. These devices tend to generate operational sound or noise when they are in operation.

It is preferable to reduce sound or noise generated in the printing machine in order to protect the environment where the machine is installed. However, the printing machine tends to increase sound or noise, since it is required to perform its operation at an accelerated speed. For this purpose, driving mechanisms of the printing machine have to operate at high speeds, which causes generation of mechanical sound or noise.

In addition to the foregoing mechanical sound or noise, various kinds of sound or noise are also generated while sheets are being conveyed through the printing machine.

FIG. 42 to FIG. 46 of the accompanying drawings are schematic views showing a sheet feeding mechanism in a printing machine. Referring to FIG. 42, the printing machine includes a printing drum 1 on which a stencil is wound. The stencil is perforated in accordance with an original image. The image is printed on a sheet 32 with ink oozing from the printing drum 1 via the stencil.

The sheet 32 is brought into pressure contact with a surface of the printing drum 1 by a press roller 3 such that ink will be easily transferred onto the sheet 32. For this purpose, the press roller 3 is swung toward the printing drum 1 while the sheet 32 is in contact with the printing drum 1. As the sheet 32 is separated from the printing drum 1, the pressure roller 3 is swung back from the printing drum 1. No ink oozes from the printing drum 1 while the pressure roller 3 stays away from the printing drum 1.

Referring to FIG. 42 again, the sheet 32 is paid out from a sheet cassette by a sheet feeder 93. The sheet feeder 93 is positioned above a sheet cassette, and includes a sheet feed roller 9 and a pick-up roller 10. The sheet feed roller 9 feeds the top sheet 32 in cooperation with a separating roller 8.

A sheet separating claw 16 and a conveyer belt 15 are located at a position which is near the printing drum 1 and opposite to the sheet feeder 93, i.e. downstream of the press roller 3. The sheet 32 separated from the printing drum 1 by the sheet separating claw 16 is conveyed by the conveyer belt 15 toward the sheet outlet. The sheet separating claw 16 blows air into a space between the printing drum 1 and the sheet 32, thereby stripping the sheet 32 from the surface of the printing drum 1.

With the foregoing sheet feeding mechanism, sound or noise is generally generated in the following cases or areas.

(1) When a leading edge of the sheet 32 strikes a nip between a pair of register rollers 6, the sheet 32 vibrates and makes sound (as shown by (a) in FIG. 42).

(2) When the register rollers 6 rotate in response to the rotation of the printing drum 1 but when the sheet feed roller 9 remains stationary, the sheet 32 is curved as shown in FIG. 43 and is then returned to its original state by tension applied thereto, generating a hissing sound (as shown by (b) in FIG. 44).

(3) The press roller 3 generates sound when it strikes the printing drum 1 (as shown by (c) in FIG. 45).

(4) The air from the sheet separating claw 16 makes a hissing sound (as shown by (d) in FIG. 46).

(5) A power transmitting mechanism also generates sound when gears come in and out of contact with their mating gears, or cams and cam followers generate slip noise during their intermittent engagement.

The hissing sound caused by the sheet in items (1) and by the sheet feeding mechanism (2) accounts for approximately 40% of the total amount of sound. Next comes the sound in item (4) and (3).

To reduce or suppress the generation of the foregoing kinds of sound, the following countermeasures are conceivable: (i) to reduce the sound generating sources; (ii) to provide vibration damping mechanisms; (iii) to provide vibration controlling mechanisms; (iv) to provide sound reducing mechanisms; and (v) to provide anti-air-vibration mechanisms.

The countermeasure (i) is most effective of all. Specifically, this countermeasure is performed by: (a) reducing a speed, at which the sheet 32 comes into contact with the register rollers 6, to a minimum range where the printing operation is allowable; (b) gently tensing the sheet 32 at a reduced speed; (c) reducing energy with which the press roller 3 is brought into contact with the printing drum 1; (d) using a belt reduction system in place of a gear reduction system; and (e) using sound reducing materials.

However, it is still difficult for the foregoing countermeasures to completely reduce sound and noise. This is because the printer has a number of openings through which sound or noise leaks outward. As described above, the printing machine has the sheet inlet and outlet, which are essential not only for feeding and discharging the sheets but also for performing maintenance work, removal of jammed sheets, and so on. Since these openings cannot be closed or sealed, sound in the printing machine tends to leak out via them.

Japanese Utility Model Laid-Open Publication No. Hei 3-093,130 proposes a sound reducing apparatus for preventing leakage of sound via a sheet inlet and a sheet outlet. The sound reducing apparatus comprises a sheet-feed-sound reducing unit and a sheet-discharge-sound reducing unit. The sheet-feed-sound reducing unit includes a stationary cover attached to a printing machine frame under a feed tray, and a movable cover supported on a support shaft of the stationary cover. The movable cover is opened and closed. The sheet-discharge-sound reducing unit is structured similarly to the sheet-feed-sound reducing unit, and includes a stationary cover and a movable cover.

A sheet cassette having a sound reducing cover is proposed in Japanese Utility Model Publication No. Hei 5-012,183. This cover is intended to reduce the size of a sheet inlet.

Japanese Patent Laid-Open Publication No. Sho 60-093, 047 proposes sheet cassettes, each of which has a sound-reducing cover.

The sound reducing mechanisms proposed in the foregoing publications seem to have the following problems. Although leakage of sound from the printing machine can be prevented by closing or sealing the openings using sound reducing members, the printing machine itself tends to become large in size and complicated in structure. Further, it becomes difficult to load or unload the sheets into or out of the printing machine. Further, there is a new problem that the printing machine requires a large vacant space around it so as to be opened and closed.

If the sheet inlet is down-sized for the purpose of sound reduction, curled or wrinkled sheets will not be fed reliably. Therefore, it is not preferable to down-size the openings or spaces around a sheet feed path without due consideration.

Further, the sheet inlet has to be large enough to allow the movement of a sheet tray on which sheets are stacked. Therefore, the larger the sheet inlet, the larger the sound reducing cover. Therefore, a large space is required to open and close the sound reducing cover.

When each sheet cassette or sheet tray has its own sound-reducing cover, the number of components will be increased, which will make the printing machine expensive.

SUMMARY OF THE INVENTION

It is an object of the invention to provide a printing machine which can reduce operational sound generated therein and prevent leakage of such sound via openings, for feeding or discharging sheets, using a simple structure, and which does not adversely affect sheet feeding performance.

It is a further object of the invention to provide a printing machine which does not require an additional installation space.

In a preferable embodiment of the invention, there is provided a printing machine which includes a cover, which can shield a space, except for at a sheet feeding area, at at least one opening for feeding or discharging sheets into or from the printing machine. The cover can reduce sound or noise leaking from the printing machine.

BRIEF DESCRIPTION OF THE DRAWINGS

Like reference characters represent like elements throughout the drawings.

DESCRIPTION OF THE PREFERRED EMBODIMENTS

Figure 1:
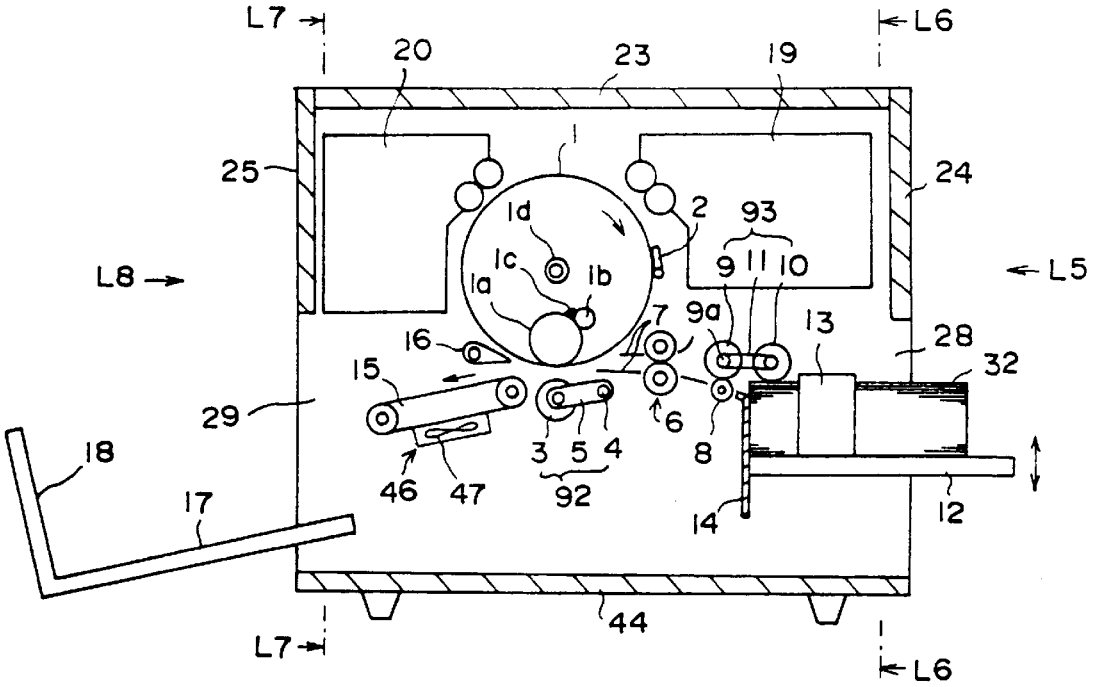
FIG. 1 is a front cross section of a printing machine to which a sound reducing apparatus according to the invention is attached.

FIG. 1 is a front cross section of a printing machine. As shown, the printing machine can stack various kinds of sheets on a sheet tray, which is vertically movable like an elevator. The printing machine adopts a straight path system which permits the sheets to be conveyed via a straight path from the sheet tray to a printed sheet tray. The straight path system enables the printing machine not only to shorten a sheet feeding time but also print a large number of sheets at a high speed. The printing machine will be outlined with reference to FIGS. 1 to 5.

Referring to FIG. 1, the printing machine comprises a printing drum 1, which includes a porous cylinder, a mesh screen wound on the cylinder, and a clamp 2 on its outer surface. The clamp 2 holds a leading edge of a stencil which is wound on the outer surface of the printing drum 1.

The stencil is selectively perforated according to an original image by a thermal head (not shown) provided in a stencil feeding/perforating station 19. The perforated stencil is fed onto the printing drum 1 and wound thereon. In FIG. 1, the stencil feeding/perforating station 19 is shown at the right side of the printing drum 1.

A stencil take-up station 20 is disposed at the left side of the printing drum 1 as shown in FIG. 1. The stencil take-up station 20 takes up a used stencil from the printing drum 1, and stores it.

Figure 3:
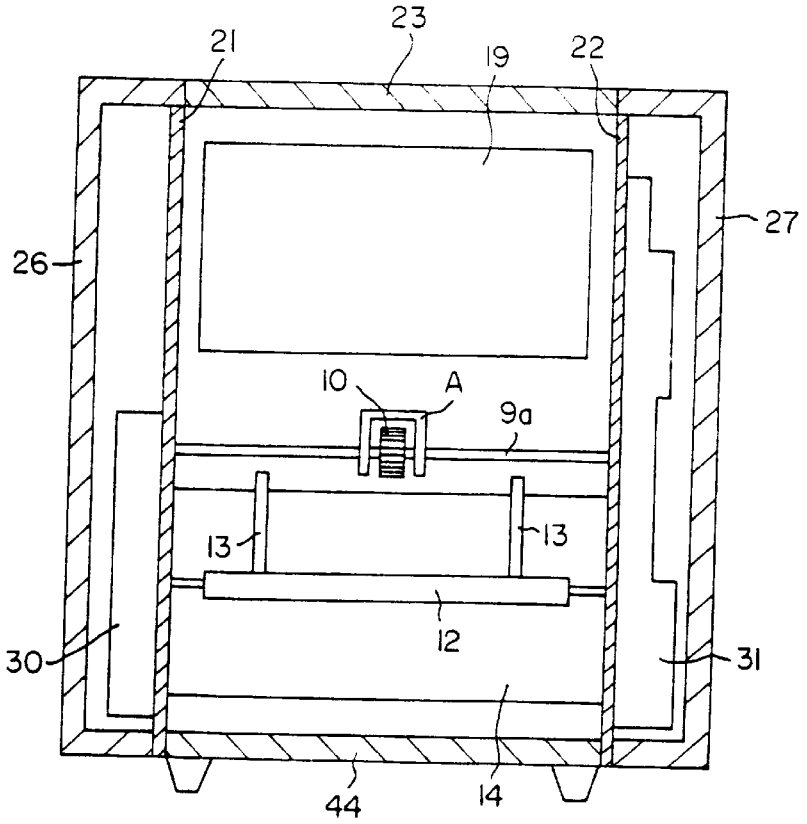
FIG. 3 is a schematic view of the printing machine, taken along line L6—L6 in FIG. 1.
Figure 4:
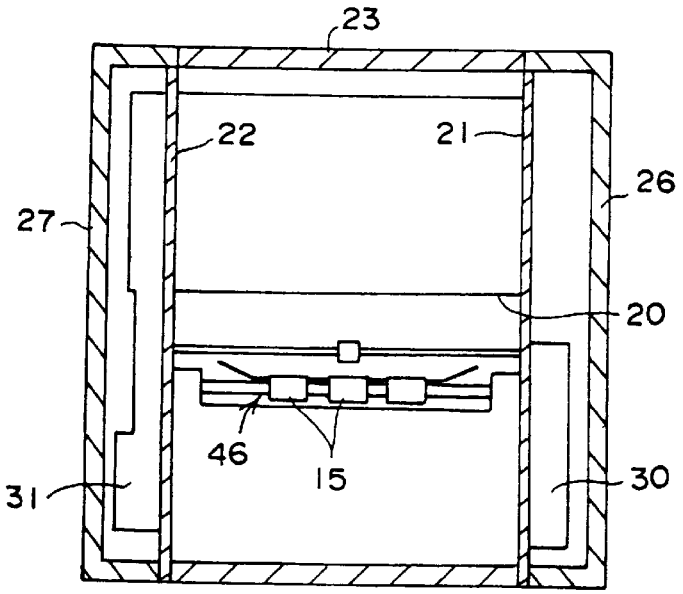
FIG. 4 is a schematic view of the printing machine, taken along line L7—L7 in FIG. 1.
Figure 5:
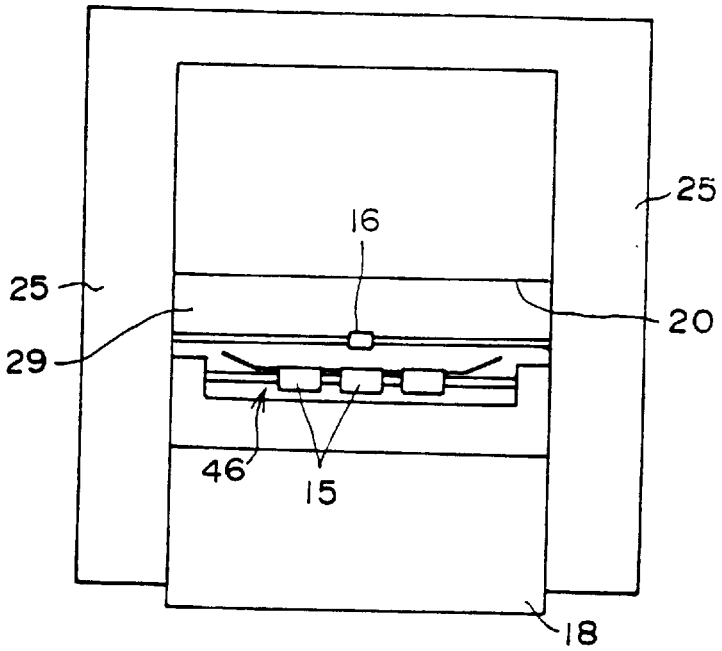
FIG. 5 is a schematic view of the printing machine, viewed in the direction shown by arrow L8 in FIG. 1.

During the printing operation, the printing drum 1 is rotated clockwise by drive units 30 and 31 (shown in FIG. 3). The printing drum 1 also includes an ink roller 1*a* and a doctor roller 1*b*, both of which are housed in the printing drum 1. The ink roller 1*a* is rotatable clockwise in synchronization with the rotation of the printing drum 1.

The doctor roller 1*b* confronts the ink roller 1*a* with a minute gap kept therebetween so as to pass a preset amount of ink. A wedge-shaped ink reservoir 1*c* is present in a space formed by the ink roller 1*a* and the doctor roller 1*b* confronting each other.

Ink is supplied to the ink reservoir 1*c* via a spout of an ink pipe 1*d*. The ink reservoir 1*c* holds an amount of ink which can be conveyed through the gap between the ink roller 1*a* and the doctor roller 1*b*. Thus, the ink is carried on the rotating ink roller 1*a*, and is applied onto an inner surface of the printing drum 1.

Referring to FIG. 1, a press roller 3 is positioned below the printing drum 1 so as to confront the ink roller 1*a* via the printing drum 1. The press roller 3 is supported on one end of an arm 5 which is swingable on a support shaft 4. Thus, the swinging motion of the arm 5 brings the press roller 3 into and out of contact with the outer surface of the printing drum 1. The press roller 3, the support shaft 4 and the arm 5 constitute an ink applying unit 92.

The ink applying unit 92 is moved away from the printing drum 1 at a timing determined by a cam which is rotatable in synchronization with the printing drum 1. This enables the ink applying unit 92 to operate without colliding with the clamp 2 on the printing drum 1. Therefore, after the clamp 2 passes in front of the ink applying unit 92, the press roller 3 is brought into contact with the printing drum 1 when the sheet 32 is conveyed into a space between the printing drum 1 and the press roller 3.

As shown in FIG. 1, a sheet separating claw 16, a conveyer belt 15, a printed sheet tray 17 and a sheet outlet 29 are positioned downstream of the printing drum 1, i.e. at the left side below the printing drum 1.

The sheet separating claw 16 strips a printed sheet 32 from the printing drum 1. For this purpose, the sheet separating claw 16 is made to swing, by a driver (not shown) toward the printing drum 1 each time the leading edge of the printed sheet 3 approaches the sheet separating claw 16. Further, the sheet separating claw 16 is connected to a pump (not shown) so as to blow air between the printed sheet 32 and the leading edge of the printing drum 1 at a predetermined timing. Thus, the leading edge of the printed sheet 32 is reliably stripped from the printing drum 1, so that the printed sheet 32 is completely separated from the printing drum 1 and is delivered onto the conveyer belt 15.

The conveyer belt 15 includes a suction mechanism for attracting the printed sheet 32. Thus, the printed sheet 32 is carried while it is being attracted onto the conveyer belt 15. The printed sheet tray 17 has an end wall 18 for neatly keeping the leading edges of printed sheets 32.

The sheet outlet 29 is also used for removing jammed sheets, maintenance work and so on.

A sheet tray 12 and a sheet feeding station 93 are positioned at the right lower side of the printing drum 1 as shown in FIG. 1. The sheet feed tray 12 is of a lift type and can stack a plurality of sheets 32. The sheet feeding station 93 is structured similarly to the sheet feeding station 93 shown in FIG. 42. The sheet tray 12 is partly fitted in the printing machine via the sheet inlet 28. The sheet inlet 28 is sized so as to make the sheet tray 12 movable therein, and facilitate removal of jammed sheets and maintenance work.

Figure 2:
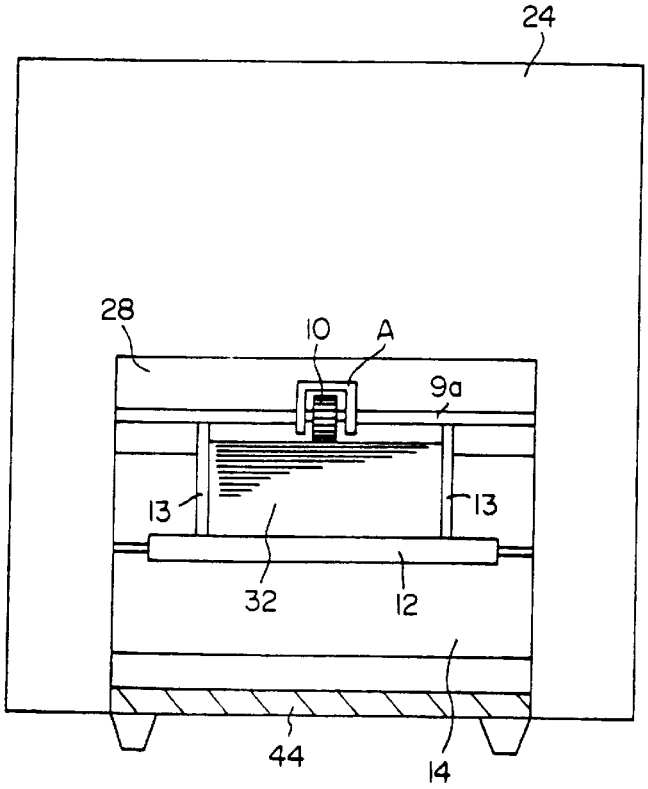
FIG. 2 is a schematic view of the printing machine, viewed in the direction shown by an arrow L5 in FIG. 1.

Referring to FIGS. 2 and 3, the sheet tray 12 is elevated by a driver (not shown) such that the top sheet 32 is brought into contact with a pick-up roller 10 with a suitable pressure (for separating the top sheet 32 from the sheet tray 12). The sheet tray 12 includes a pair of side plates 13 which are adjustable according to the size of sheets 32. One of the side plates 13 is moved by manually operating a rack-and-pinion unit, so the other side plate 13 is adjusted accordingly.

As shown in FIG. 1, the sheet feeding station 93 includes a feed roller 9, the pick-up roller 10, an endless belt 11, a separation roller 8, a pair of register rollers 6, and a pair of guide plates 7. The feed roller 9 is rotatably supported on a support shaft 9*a* extending between side plates 21, 22 (shown in FIG. 3) of the printing machine. The pick-up roller 10 is supported by a member attached to the support shaft 9*a* such that the pick-up roller 10 is swingable. The endless belt 11 extends between the feed roller 9 and the pick-up roller 10. The separation roller 8 is in pressure contact with the feed roller 9 so as to prevent a plurality of sheets 32 from being fed simultaneously. The register rollers 6 are attached to the side plates 21, 22 so as to be rotatable. The pair of guide plates 7 guide the sheet 32 into a nip between the register rollers 6.

The feed roller 9 is supported on a shaft 9*a* so as to be rotatable, and is covered by a cover A. The shaft 9*a* is rotatably supported by the side plates 21, 22. The cover A also covers the pick-up roller 10. The feed roller 9 is rotated clockwise by a feed gear unit (not shown). The feed gear unit includes a cam rotatable in synchronization with the printing drum 1, a sector gear having a cam follower engaged with the cam, a one-way clutch, and so on.

The register rollers 6 are rotated in different directions by a register roller gear unit, which is similar to the feed roller gear unit. Specifically, the lower register roller 6 is rotatable counterclockwise. The register rollers 6 feed the sheet 32 at a speed which is equal to a peripheral speed of the printing drum 1.

The printing machine includes a top cover 23, an inlet-side side cover 24, an outlet-side side cover 25, a front cover 26, and a rear cover 27. The top cover 23 wraps the upper part of the printing machine. The inlet-side side cover 24 protects an area between a top cover and the sheet inlet 28. The outlet-side side cover 25 protects an area between the top cover and the sheet outlet 29, and is positioned at an end opposite to the sheet tray 12. The front and rear covers 26 and 27 cover the front and rear parts of the printing machine. These covers are detachable from the printing machine.

In FIG. 1, reference numeral 14 denotes a wall plate for holding the leading edges of the sheets 32, 20 denotes a stencil take-up unit, 46 denotes a suction-type sheet discharging station, and 47 denotes a fan disposed under the conveyer belt 15.

Figure 42:
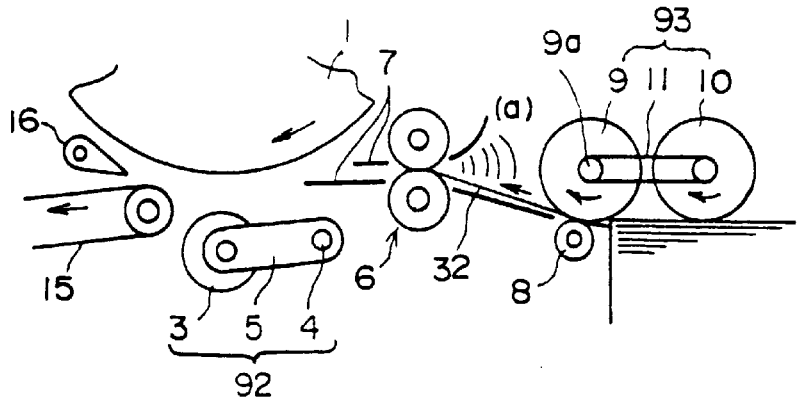
FIG. 42 is a schematic view showing a probable sound source in a prior art printing machine.
Figure 43:
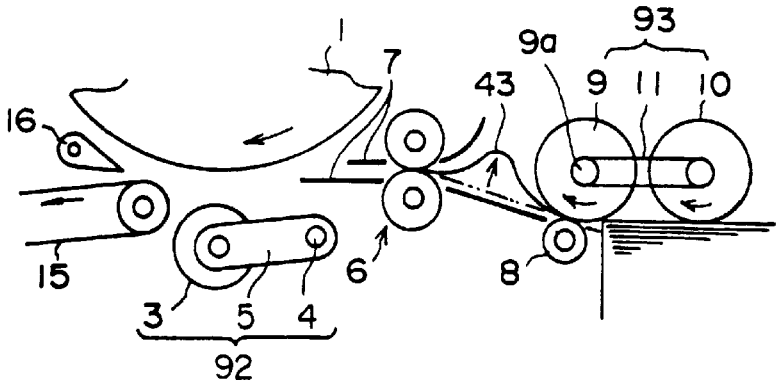
FIG. 43 is a view similar to FIG. 42, but showing another probable sound source in the prior art printing machine.
Figure 44:
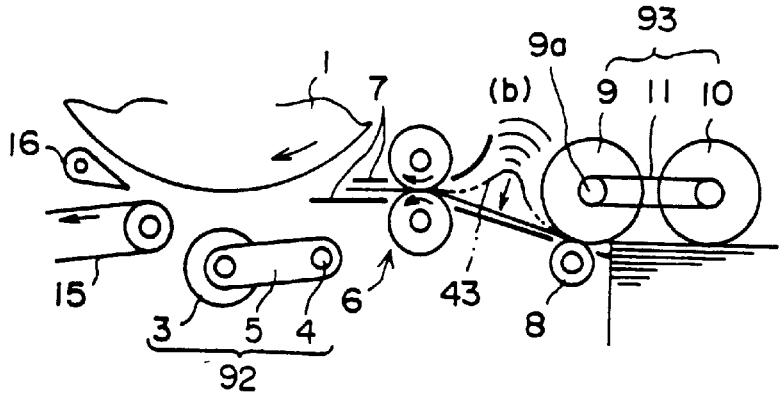
FIG. 44 is a view similar to FIG. 43, but showing a further probable source in the prior art printing machine.
Figure 45:
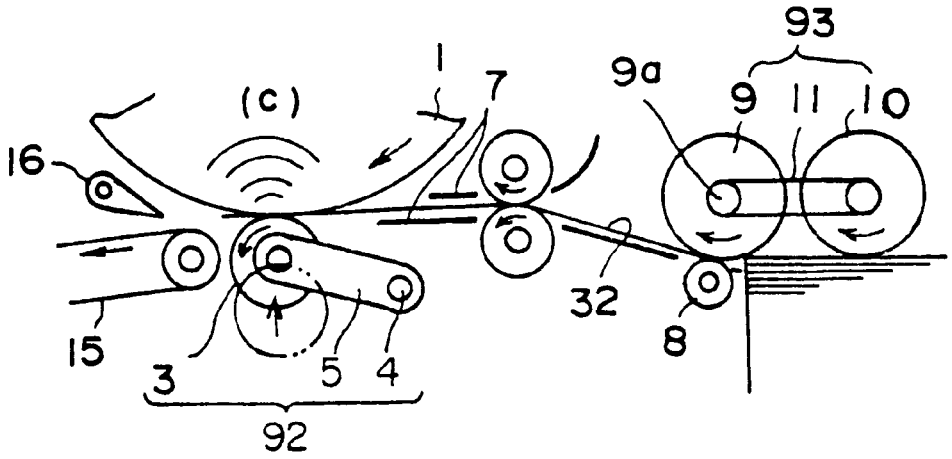
FIG. 45 is a schematic view showing a still further probable sound source in the prior art printing machine.
Figure 46:
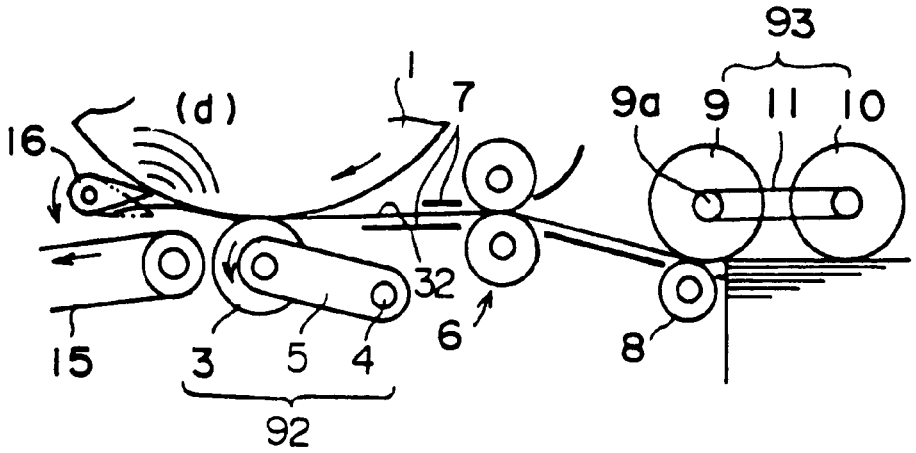
FIG. 46 is a view similar to FIG. 45, but showing a further probable sound source in the prior art printing machine.

The sheets 32 are conveyed through the printing machine in the following manner. The top sheet 32 is fed from the sheet tray 12 to the register rollers 6 by the rotating pick-up roller 10 and feed roller 9. Both the pick-up roller 10 and the feed roller 9 prevent the feeding of duplicate or multiple sheets 32. The rollers 10 and 9 stop rotating as soon as the sheet 32 strikes the nip between the register rollers 6 with its leading edge, is fed forward further, and is curved as shown in FIG. 42 Thereafter, the register rollers 6 are rotated again by the cam at a preset timing. The curved sheet 32 begins returning to its original state as shown in FIG. 44. Then, the feed roller 9 and the pick-up roller 10 are rotated clockwise (in the sheet feeding direction) in response to the sheet 32 being conveyed. Thus, the sheet 32 is transported to an ink applying unit 92.

As soon as the sheet 32 enters a gap between the press roller 3 and the outer surface of the printing drum 1, the press roller 3 is brought into pressure contact with the printing drum 1. While this is happening, the image perforated on the stencil is transferred onto the sheet 32 and is printed thereon using the ink. After being printed, the sheet 32 is stripped from the printing drum 1 by the sheet separating claw 16 and air blown therefrom.

A sound reducing apparatus according to the invention comprises a sound reducing unit applicable to a sheet inlet and/or a sound reducing unit applicable to a sheet outlet, of the printing machine, respectively. First to fourth embodiments relate to sound reducing units which are applicable to the sheet inlet while fifth to tenth embodiments relate to sound reducing units which are applicable to the sheet outlet.

Embodiment 1

A sound reducing unit according to a first embodiment will be described with reference to FIGS. 6 to 10. The sound reducing unit is applicable to the sheet inlet 28 of the printing machine, and includes three sound reducing covers.

A first sound reducing cover is an inlet cover 50 attached behind the inlet-side side cover 24. The inlet-side side cover 24 is positioned above the sheet tray 12, and is shaped so as to constitute a part of the sheet inlet 28. The sheet inlet 28 is sized such it can reliably load and unload the sheet tray 12 even when the sheet tray 12 is raised to its highest extent. The sheet tray 12 is longitudinally movable as shown by a double-headed arrow in FIG. 6.

The longitudinal movement of the sheet tray 12 is controlled by drive units 130 and 131 (shown in FIG. 9) such that each top sheet 32 is brought into contact with a pick-up roller 10 with a pressure which enables the pick-up roller 10 to pick up the top sheet 32. In other words, the sheet tray 12 is gradually lifted according to the number of sheets 32. Thus, each top sheet 32 is always in contact with the pick-up roller 10.

Figure 8:
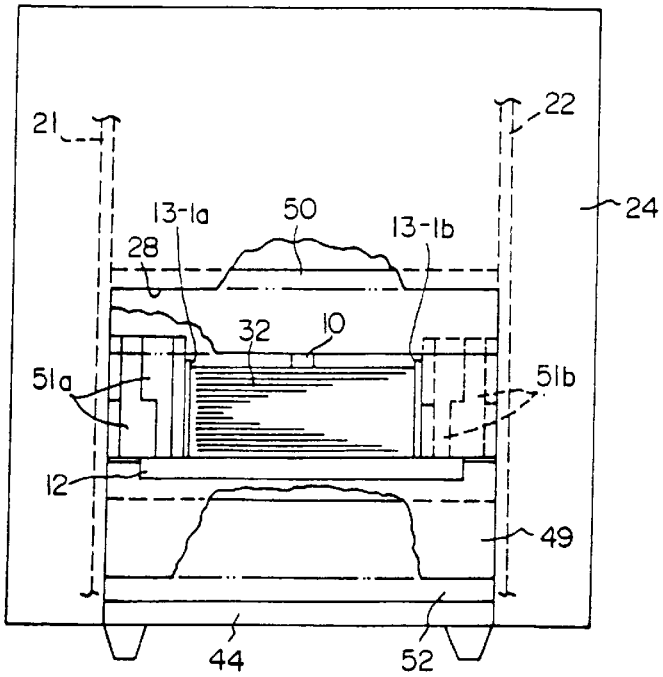
FIG. 8 is a schematic view of the printing machine, viewed in the direction shown by arrow L9 in FIG. 6.

The inlet cover 50 is attached on an inner surface of the inlet-side side cover 24 so as to partially shield the sheet inlet 28 with a vacant space X kept above the top sheet 32. Further, the inlet cover 50 shields a space between a pair of side plates 21 and 22 in a direction corresponding to a depth of the printing machine (i.e. in the direction corresponding to a width of the sheet 32) as shown in FIG. 8. The vacant space X is preferably approximately 2 mm to 5 mm to allow for the presence of curled or wrinkled sheets 32.

The sheet tray 12 is raised in response to the amount of sheets 32 thereon such that each top sheet 32 is in contact with the pick-up roller 10. The tray side plates 13-1*a* and 13-1*b* (to be described later) are also raised with the sheet tray 12. Therefore, the inlet cover 50 is positioned between the tray side plates 13-1*a* and 13-1*b* and the inlet-side side cover 24, and is in close contact with the inlet-side side cover 24. Alternatively, the inlet-side side cover 24 may be sized so as to include the inlet cover 50 as an integral part.

The inlet cover 50 is made of a semi-transparent acrylic plate so as to facilitate detection of problems such as sheet jamming. In order to promote the reduction of sound or noise, a sound reducing member 57 is attached to a bottom of the stencil feeding/perforating station 19 and an inner surface of the inlet cover 50. However, the sound reducing member 57 is partly absent from the inlet cover 50 so as to facilitate the detection of jammed sheets or other problems. The sound reducing member 57 is made of foam type material such as VD FOAM (trade name, produced by Bridgestone Co., Ltd.) which is 10 mm or 20 mm thick.

A sheet tray button (not shown) is depressed when jammed sheets 32 are removed from the sheet tray 12, or when fresh sheets 32 are refilled into the sheet tray 12. Depression of this button enables the sheet tray 12 to descend, thereby widening the space X. Thus, sheets 32 can be easily removed or resupplied.

Referring to FIGS. 6, 8, 9 and 10, a second sound reducing cover is a sound reducing bottom cover 52. The lower portion of the sheet inlet 28 becomes larger as the sheet tray 12 is raised according to the number of sheets 32 thereon. The sheet tray 12 is prevented from going further down by a stop (not shown).

Figure 6:
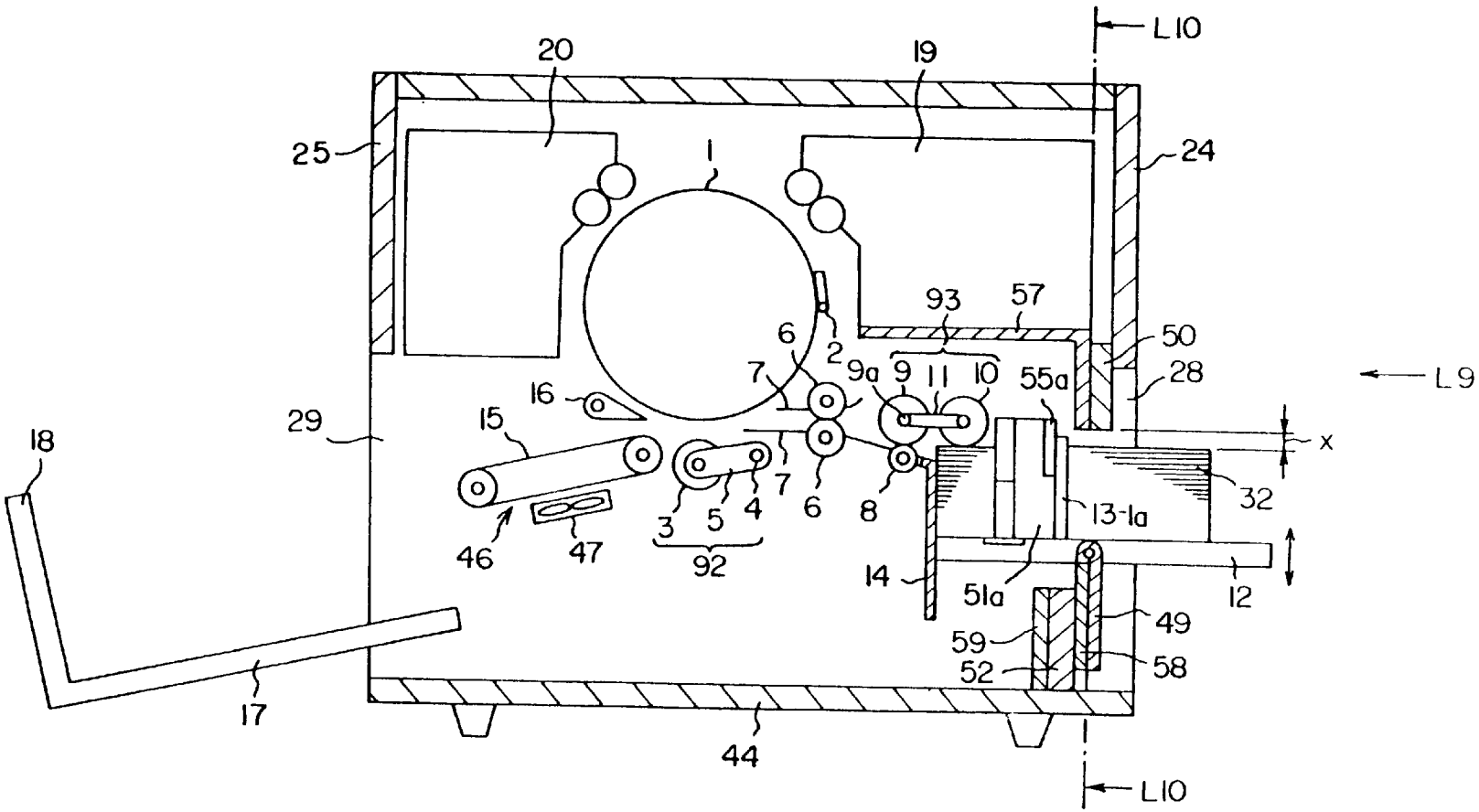
FIG. 6 is a front cross section of a printing machine, in which a sound reducing unit according to a first embodiment of the invention is attached in the vicinity of a sheet tray.

The sound reducing bottom cover 52 is attached to the bottom cover 44, and extends to the aforementioned stop. A movable cover 49 is attached to the sheet tray 12. This movable cover 49 overlaps with the sound reducing bottom cover 52 as shown in FIG. 6.

Figure 9:
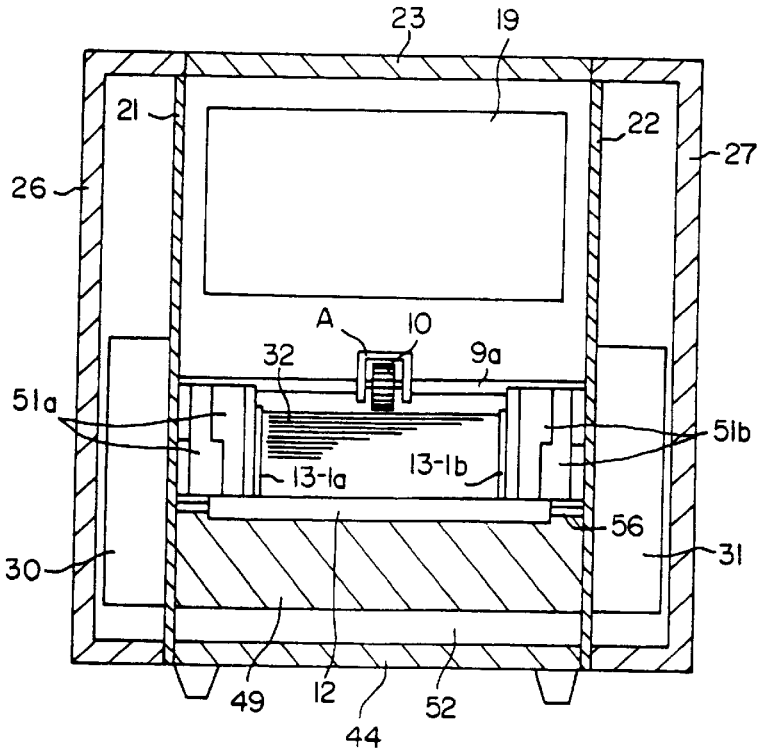
FIG. 9 is a cross section of the printing machine, taken along line L10—L10 in FIG. 6.
Figure 10:
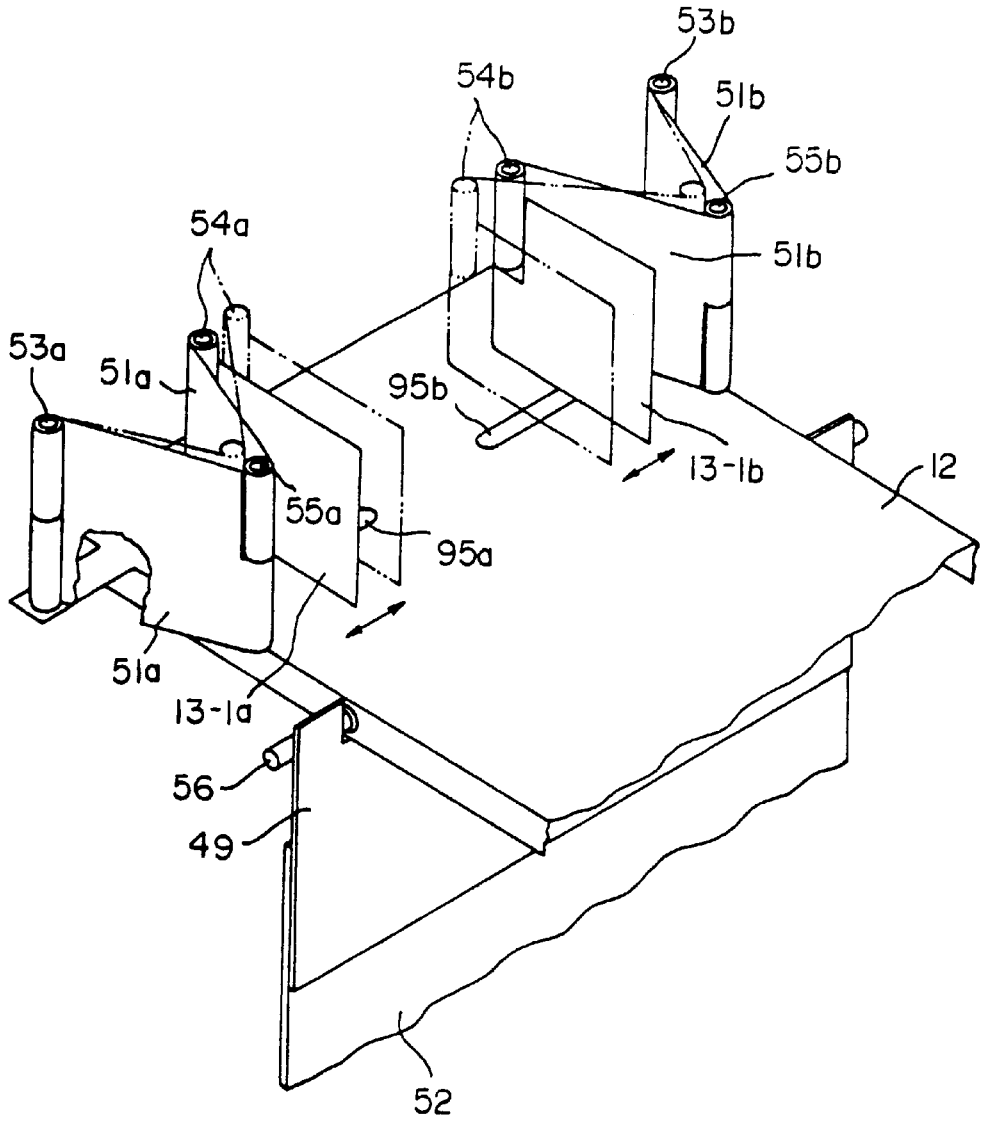
FIG. 10 is a perspective view of a sound reducing cover in the sound reducing unit of FIG. 6.

As can be seen from FIGS. 8, 9 and 10, both the movable cover 49 and the sound reducing bottom cover 52 respectively extend between the side plates 21 and 22 of the printing machine.

Referring to FIGS. 9 and 10, upper side edges of the movable cover 49 are connected to a non-rotatable shaft 56 for transmitting a force for the upward and downward movement of the sheet tray 12. Therefore, the movable cover 49 is raised in contact with the sound reducing bottom cover 52 as the sheet tray 12 ascends. The movable cover 49 covers the sheet inlet 28 except for the area through which the sheet tray 12 is attached. In other words, the movable cover 49 has a recess at a position thereof corresponding to a part of the sheet inlet 28 where the sheet tray 12 is attached. The sheet tray 12 is loaded into the printing machine via the recess of the movable cover 49.

The extent of the overlap of the sound reducing bottom cover 52 and the movable cover 49 is determined such that sound or noise can be sufficiently reduced when the sheet tray 12 is raised highest. Further, since the sheets 32 are stacked as high as the sheet side plates 13-1*a* and 13-1*b*, the overlap should be equal to the height of the tray side plates 13-1*a* and 13-*b*.

The sound reducing bottom cover 52 extends between the side plates 21 and 22, and are attached to these side plates 21, 22. The drive units 130 and 131 are positioned near the side plates 21 and 22. These drive units 130 and 131 generate less sound or noise than the units or members in a space defined by the side plates 21 and 22. Thus, the sound reducing bottom cover 52 suffices for sound or noise reduction around this area.

Figure 7:
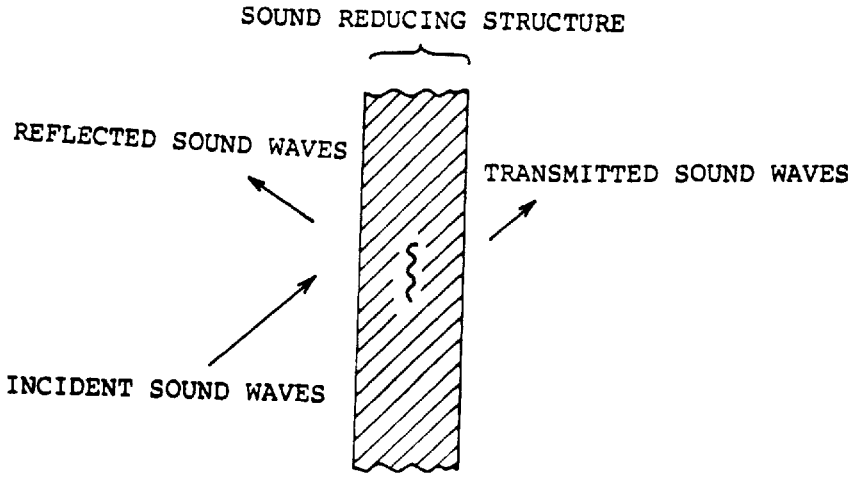
FIG. 7 shows sound reducing performance of a sound reducing material.

The sound reducing bottom cover 52 is made of a steel plate having a large sound reducing index. The sound reduction index represents a difference between the power of the transmitted sound and the power of the incident sound. As shown in FIG. 7, the incident sound passes through a sound reducing structure (sound reducing material), and leaves therefrom as the transmitted sound. The larger the sound reducing index, the better the sound reducing performance. The sound reducing index is measured in accordance with JIS. A 1416, "Measurement of Acoustic Sound Reduction Index in Laboratories".

As shown in FIG. 6, sound reducing and damping members 58 and 59 are respectively bonded to both the movable cover 49 and the sound reducing bottom cover 52 so as to enhance the sound reducing effect. The members 58 and 59 are made of 10-mm or 20-mm thick foaming material such as a VD FOAM (trade name, produced by Bridgestone Co., Ltd.), and have a vibration damper made of LR DAMPER (trade name, produced by Bridgestone Co., Ltd.). The vibration damper is 2-mm thick. The foaming material and vibration damper are bonded to each other. The sound reducing bottom cover 52 and the movable cover 49 can effectively reduce and block sound leaking via the space under the sheet tray 12. The thicker the better. However, a thickness of the sound reducing and suppressing members 59 and 58 is appropriately determined such that they do not adversely affect the units surrounding them.

A third sound reducing cover is constituted by a pair of collapsible covers 51*a* and 51*b* which are disposed between the side plate 21 and the sheet side plate 13-1*a* and between the side plate 22 and the sheet side plate 13-1*b*, shown in FIGS. 8 and 9.

Positions of the sheet side plates 13-1*a* and 13-1*b* are adjustable in the width direction of the sheets 32 using a mechanism including racks and pinions (not shown). When one sheet side plate 13-1*a* or 13-1*b* is adjusted according to a width of the sheets 32, the other sheet side plate will be adjusted accordingly.

When the sheet side plates 13-1*a* and 13-1*b* are displaced according to the size of sheets 32, there are vacant spaces defined by these plates 13-1*a* and 13-1*b* and the opposite side edges of the sheet inlet 28.

These vacant spaces are closed by collapsible covers 51*a* and 51*b*. Specifically, they are collapsible at their centers, and are respectively housed between the sheet side plate 13-1*a* and the side plate 21 of the printing machine body and between the sheet side plate 13-1*b* and the side plate 22 of the printing machine body when the sheet side plates 13-1*a* and 13-1*b* are at the opposite ends of the sheet inlet 28.

Referring to FIG. 10, one end of the collapsible covers 51*a* is supported by a pin 54*a* which is attached to one end of the sheet side plate 13-1*a*, near the pick-up roller 10. Thus, the collapsible cover 51*a* is prevented from protruding from the sheet side plate 13-1*a*. The collapsible cover 51*b* is structured similarly to the collapsible cover 51*a*, and supported by a shaft 54*b*.

The other end of the collapsible cover 51*a* is supported by a stationary shaft 53*a*, which is fixed on a tab extending from the sheet tray 12. The stationary shaft 53*a* is positioned in front of the wall 14 (FIG. 6) of the sheet tray 12 similarly to the shaft 54*a*. The collapsible cover 51*b* is structured similarly to the collapsible cover 51*a*. Thus, the collapsible covers 51*a* and 51*b* shield the vacant spaces present outside the sheet side plates 13-1*a* and 13-1*b* holding the side edges of the sheets 32 on the sheet tray 12.

Each of the collapsible covers 51*a* and 51*b* includes two separate members, which are collapsible on a pin 55*a* (55*b*). The pin 55*a* (55*b*) is free at its top and bottom. Referring to FIG. 10, the sheet side plates 13-1*a* and 13-1*b* are movable in elongated openings 95*a* and 95*b* on the sheet tray 12 according to the size of the sheets 32.

According to the foregoing arrangement, when the sheet side plates 13-1*a* and 13-1*b* are moved according to the size of the sheets 32, the stationary shafts 53*a* and 53*b* remain immovable while the pins 54*a*, 54*b*, 55*a* and 55*b* are movable following the sheet side plates 13-1*a* and 13-1*b*. Thus, the collapsible covers 51*a* and 51*b* follow the movement of the sheet side plates 13-1*a* and 13-1*b*. In this embodiment, the size of the collapsible covers 51*a* and 51*b* is determined so as to be compatible with the sheets 32 of from A6 to A3 size.

Referring to FIGS. 6 and 8, the height of the collapsible covers 51*a* and 51*b* is larger than the height of the inlet cover 50 so that these covers 51*a*, 51*b* and 50 overlap. Specifically, X (shown in FIG. 6) is 5 mm, the distance between the top of the sheet side plates 13-1*a*, 13-1*b* and the top of the collapsible covers 51*a*, 51*b* is 10 mm to 20 mm. In this case, when the sheet tray 12 is full with sheets 32, i.e. the sheets 32 are as high as the sheet side plates 13-1*a* and 13-1*b*, the inlet cover 50 overlaps with the collapsible covers 51*a* and 51*b* by 5 mm. Thus, little sound or noise will leak through spaces between the sheet side plates 13-1*a*, 13-1*b* and the side plates 21, 22.

The collapsible covers 51*a*, 51*b* are made of a steel plate having a large sound reduction index, similar to those used for the sound reducing bottom cover 52 and the movable cover 49. The collapsible covers 51*a*, 51*b* are coated with a sound reducing material similar to that used for the tray bottom shield 52 so as to effectively reduce sound leaking through the space between the sheet side plates 13-1*a*, 13-1*b* and the side plates 21, 22.

In the first embodiment, the sound reducing unit can shield the sheet inlet 28 from all directions except for the area the sheets 32 actually pass through, and can reduce sound or noise leaking through the sheet inlet 28. The sound reducing unit can lower a noise level in the printing machine by 2 to 6 dB(A) as shown in Table 1.

TABLE 1

Unit: dB(A)

| | Measured Positions | | | |
|---|---|---|---|---|
| | Front side of machine | Rear side of machine | Feed side | Discahrge side |
| Printing machine without sound reducing apparatus | 62.8 | 62.1 | 67.3 | 66.7 |
| Printing machine with sound reducing apparatus | 59.7 | 60.2 | 61.3 | 63.4 |

The sound reducing unit according to the first embodiment can reliably and effectively reduce sound or noise leaking via the sheet inlet 28 of the printing machine. During the printing, each top sheet 32 stays at the predetermined height. Therefore, the inlet cover 50 shields the space present 2 mm to 5 mm above the top sheet 32 on the sheet tray 12, thereby reducing sound or noise leaking via this space. This arrangement enables reduction of a noise or sound level by 4 to 5 dB(A) compared with a case in which the foregoing inlet cover 50 is not used.

The inlet cover 50 shields the space higher than 2 mm to 5 mm above the top sheet 32 on the sheet tray 12, which allows curved or wrinkled sheets to be fed from the sheet tray 12. Further, the inlet cover 50 present inside the printing machine body does not enlarge the printing machine body, which can shield the vacant space at a reduced cost and does not require a space for its opening and closing.

Embodiment 2

A sound reducing unit according to a second embodiment will be described with reference to FIGS. 11 to 15.

Figure 11:
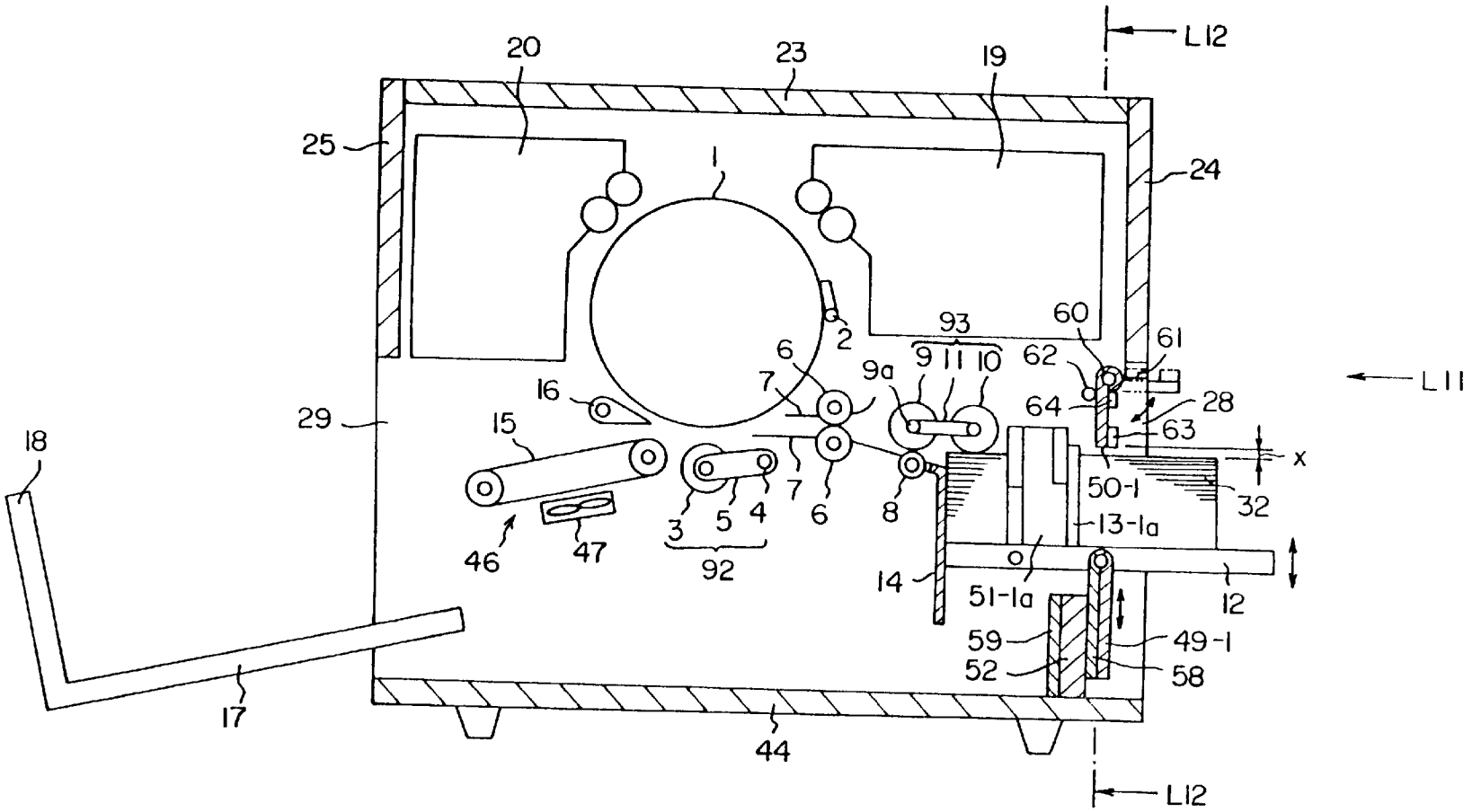
FIG. 11 is a view similar to FIG. 6, but showing a sound reducing unit of a second embodiment attached to the printing machine.
Figure 12:
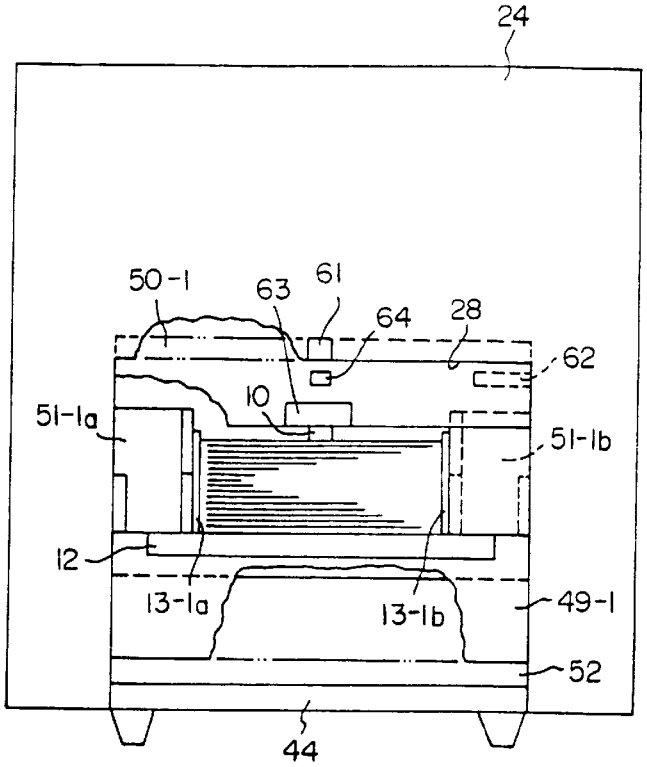
FIG. 12 is a schematic view of the printing machine, viewed in the direction shown by arrow L11 in FIG. 11.

Referring to FIG. 11, the sound reducing unit includes a swingable inlet cover 50-1, which can shield a part of the sheet inlet 28. The inlet cover 50-1 is supported by a shaft 60 extending between the side plates 21 and 22.

The inlet cover 50-1 is swingable on the shaft 60. When the inlet cover 50-1 swings toward the inlet-side side cover 24, the sheet inlet 28 is wide open. The inlet cover 50-1 usually closes the upper portion of the sheet inlet 28 with the space X maintained above the top sheet 32 on the sheet tray 12.

This arrangement allows the removal of jammed sheets or maintenance work without lowering the sheet tray 12. To open the inlet cover 50-1, a grip 63 on the front surface of the inlet cover 50-1 is pulled such that a magnet receiver 64 on the inlet cover 50-1 is magnetically attracted to a magnet 61 at the bottom of the inlet-side side cover 24. Thus, the inlet cover 50-1 maintains its state as shown by a dashed line in FIG. 11. In this state, jammed sheets will be removed or the maintenance work will be performed.

After the forgoing work, the inlet cover 50-1 is returned to its original position. In this state, the inlet cover 50-1 remains immovable after it comes into contact with a stop 62. The printing operation will be started after the inlet cover 50-1 is closed.

The inlet cover 50-1 is effective in reducing sound or noise leaking via the space above the top sheet 32. The inlet cover 50-1 is the same as the inlet cover 50 (of the first embodiment) with respect to its material and shape.

Collapsible covers 51-1*a* and 51-1*b*, in place of the collapsible covers 51*a* and 51*b*, can shield spaces which are present between the opposite side edges of the sheet inlet 28 and the front and rear covers 26 and 27 of the printing machine body. A movable cover 49-1 is used in place of the movable cover 49 in the first embodiment.

This arrangement shields the spaces added to the sheet inlet 28 when the sheet tray 12 is moved laterally (i.e. in the width direction of the sheets 32). The collapsible covers 51-1*a* and 51-1*b* are respectively supported by immovable shafts 53-1*a* and 53-1*b* (corresponding to the shafts 53*a* and 53*b* shown in FIG. 10 in the first embodiment). These shafts 53-1*a* and 53-1*b* are fixed to plates (not shown) extending downward from inner surfaces of racks 65*a* and 65*b*.

Figure 15:
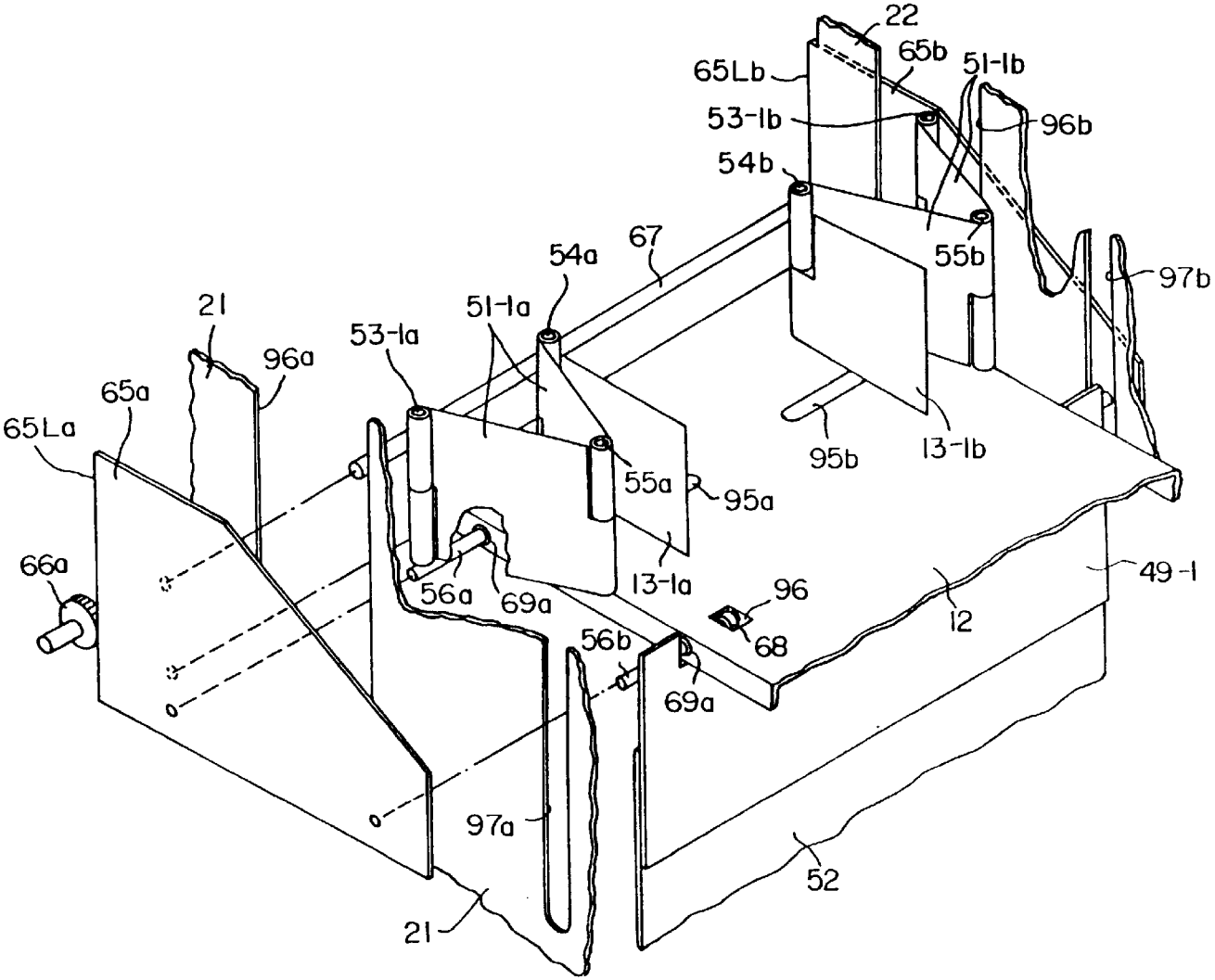
FIG. 15 is a perspective view of a sound reducing cover in the sound reducing unit of FIG. 11.

The sheet tray 12 is moved up and down, and moved laterally in the following manner. As shown in FIG. 15, the sheet tray 12 is supported by tray shafts 56*a* and 56*b*, which extend between the rack members 65*a* and 65*b*, and are fixed to them. The racks 65*a* and 65*b* are disposed between the side plates 21, 22 and side covers 26, 27, respectively. Racks 65L*a* and 65L*b* are attached to edges of the rack members 65*a* and 65*b*. Pinions 66*a* and 66*b* are engaged with the racks 65L*a* and 65L*b*, respectively, as shown in FIG. 15. The pinion 66*b* is not shown in FIG. 15.

The pinions 66*a* and 66*b* are fixed on a drive shaft 67, which is rotated by a motor (not shown). The sheet tray 12 is moved up and down via the pinions 66*a*, 66*b* and the racks 65L*a*, 65L*b*.

Figure 13:
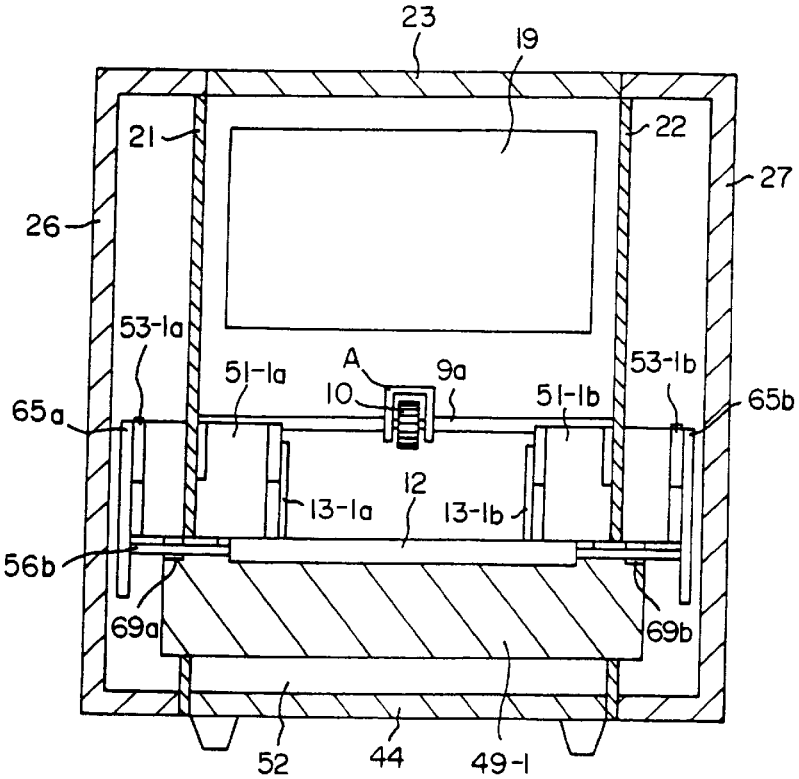
FIG. 13 is a cross section of the printing machine, taken along line L12—L12 in FIG. 11.
Figure 14:
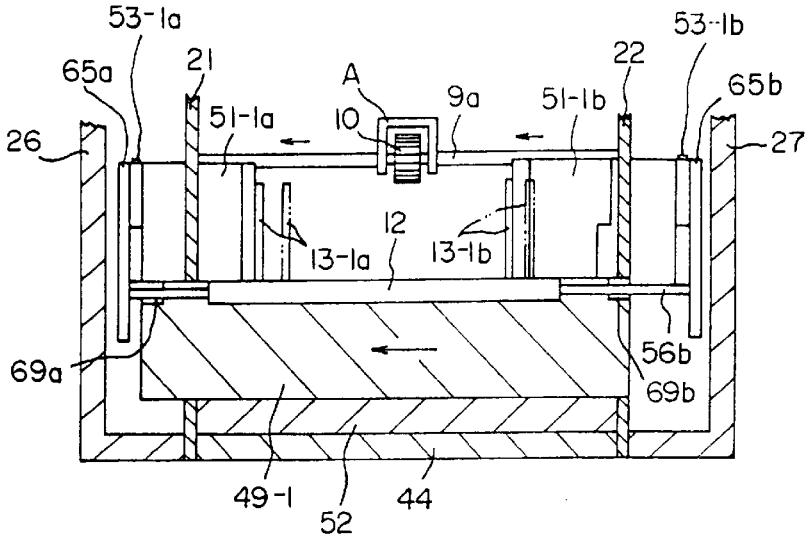
FIG. 14 is a partial cross section of the printing machine, taken along line L12—L12 in FIG. 11.

The sheet tray 12 is laterally movable as shown in FIGS. 13 to 15. A pair of sliding bearings 69*a* and 69*b* are attached to the sheet tray 12, and receive the shafts 56*a* and 56*b*, on which the bearings 69*a* and 69*b* are slidable. Since the shafts 56*a* and 56*b* are prevented from moving axially by a stop (not shown), the sheet tray 12 is movable on the shafts 56*a* and 56*b*.

The lateral movement of the sheet tray 12 is controlled as follows. Referring to FIG. 15, the shaft 56*b* is partially threaded under the sheet tray 12. The sheet tray 12 has an opening 96, through which a nut 68 is exposed. The nut 68 is attached on the threaded portion of the shaft 56*b*. The sheet tray 12 is laterally movable according to a direction in which the nut 68 is manually turned. The sheet tray 12 is designed to be movable by approximately 20 mm.

The movable cover 49-1 shields the space between the side plates 21 and 22 as shown in FIGS. 13 and 14. The movable cover 49-1 is widened by 15 mm at its opposite ends such that these ends reach spaces between the side plate 21 and the front cover 26 and between the side plate 22 and the rear cover 27, respectively. This is because the sheet tray 12 is laterally movable by 20 mm. The movable cover 49-1 overlaps, at its opposite ends, with the side plates 21 and 22. The movable cover 49-1 is fixed to the sheet tray 12, and is laterally movable with the sheet tray 12. Further, the side plate 21 has elongated openings 96*a* and 97*a* while the side plate 22 has elongated openings 96*b* and 97*b*. The elongated openings 96*a*, 97*a*, 96*b* and 97*b* enable the movable cover 49-1, and shafts 56*b*, 56*b* to move with the sheet tray 12 without coming into contact with the side plates 21 and 22. The elongated openings 96*a* and 96*b* are sized such that collapsible covers 51-1*a* and 51-1*b* (to be described later) are also movable without coming into contact with the side plates 21 and 22. The movable cover 49-1 is the same as the movable cover 49 of the first embodiment, and is not described in detail here.

The movable cover 49-1 overlaps with the side plates 21 and 22. Thus, it is possible to reduce sound or noise leaking from under the sheet tray 12 even when the sheet tray 12 is laterally moved.

The collapsible covers 51-1*a* and 51-1*b* are supported by stationary shafts 53-1*a* and 53-1*b*, which are fixed to plates (not shown) extending from the inner surfaces of the rack members 65*a* and 65*b*. Thus, the collapsible covers 51-1*a* and 51-1*b* overlap with the side plates 21 and 22, respectively. These collapsible covers 51-1*a* and 51-1*b* are the same as the collapsible covers 51*a* and 51*b* of the first embodiment. Therefore, they will not be described here.

The collapsible covers 51-1*a* and 51-1*b* can reliably and effectively reduce sound or noise leaking via the spaces between the sheet tray side plates 13-1*a*, 13-1*b* and the side plates 21 and 22. These covers can also reduce noise or sound even when the sheet tray 12 is moved laterally.

The sound reducing unit of the second embodiment facilitates the removal of jammed sheets. Further, even when the sheet tray 12 is moved laterally, the sound reducing unit can shield the sheet inlet 28 except for the sheet passing area, thereby reducing sound or noise leaking via the sheet inlet 28. This sound reducing unit can lower a noise level by 2 to 6 dB(A), as shown in Table 1, compared with an example of a conventional printing machine without the sound reducing unit.

Embodiment 3

The invention will be described with respect to a third embodiment shown in FIGS. 16 to 20.

Referring to FIG. 11, the stationary cover 52 and the movable cover 49-1 overlap with each other even when the sheet tray 12 is full with sheets 32 or even when the sheet tray 12 is raised to the highest level. The printing machine is required to have a space for overlapping the foregoing covers, which means that the printing machine becomes higher and larger.

Figure 16:
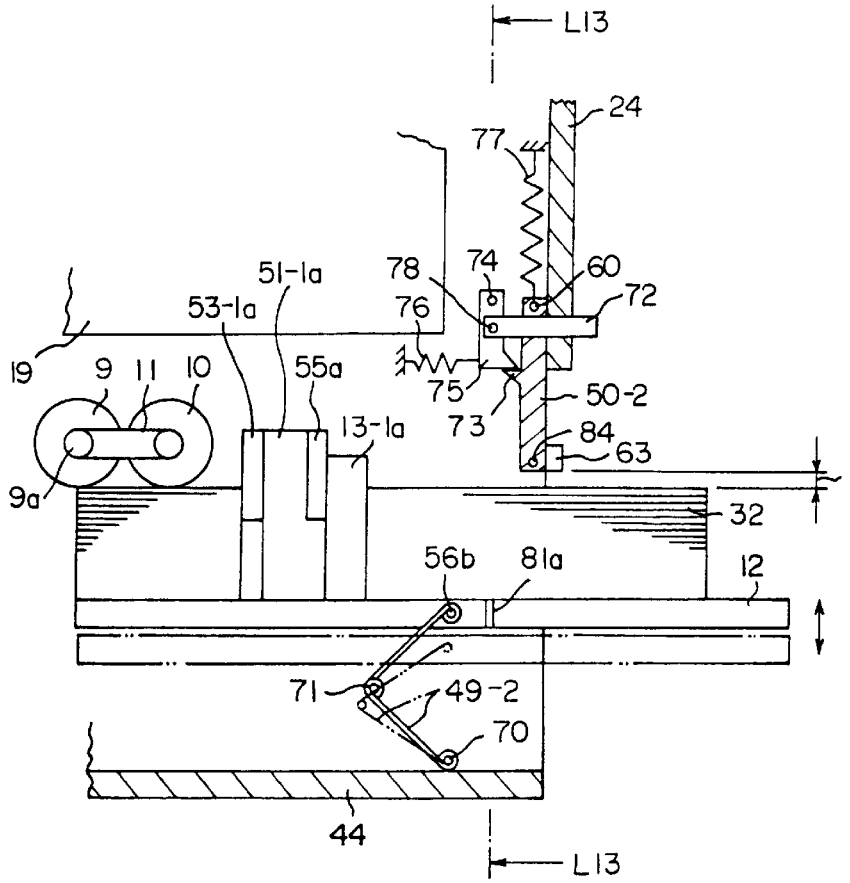
FIG. 16 is a cross section of a sound reducing unit according to a third embodiment attached to the printing machine.
Figure 17:
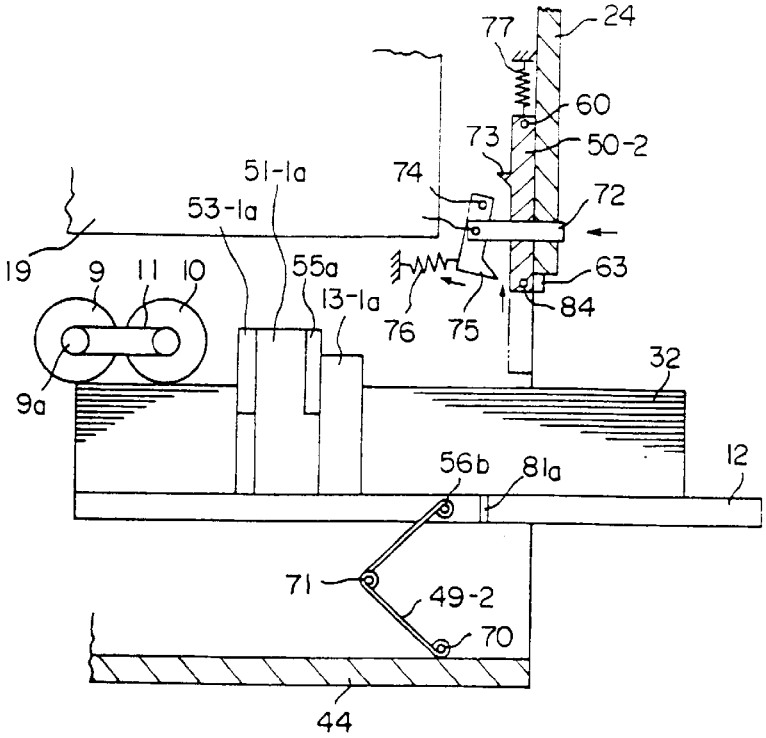
FIG. 17 is a view similar to FIG. 16, but showing the operation of the sound reducing unit of FIG. 16.

In this embodiment, an inlet cover 50-2 is attached to the inlet-side side cover 24 such that it can be moved up and down thereon, as shown in FIGS. 16 and 17. Therefore, to secure an open space above the sheet tray 12, the inlet cover 50-2 is moved upward, and does not project over the sheets 32.

The inlet cover 50-2 has a grip 63 on its outer surface, and a catch 73 on its inner surface, which is pulled by a tension spring 77. Further, the inlet cover 50-2 is supported by a stationary shaft 60 at the top thereof, and is supported by a sliding shaft 84 at the bottom. The stationary shaft 60 and the sliding shaft 84 fit into elongated openings (not shown) on the side plates 21 and 22, and are slidable therein. The catch 73 is engageable with a stop 75, which is supported and is rotatable on a shaft 74 connected to an immovable member (not shown).

The stop 75 has a shaft 78, to which a rod 72 is coupled in a rotatable manner. At the other end, the rod 72 passes through an opening in the inlet-side side cover 24, and projects therefrom. The rod 72 is slidable in this opening. A free end of the stop 75 is urged by a compression spring 76. As shown in FIG. 16, the inlet cover 50-2 is structured such that it shields the part of the sheet inlet 28 with the space X maintained on the top sheet 32.

To open the inlet cover 50-2, the rod 72 is pushed at its projecting end. Then, the stop 75 is made to swing on the shaft 74 and disengages itself from the catch 73. Thereafter, the inlet cover 50-2 is pulled by the tension spring 77. Therefore, the stationary shaft 60 and the sliding shaft 84 as well as the inlet cover 50-2 are pulled upward in the elongated opening on the side plates 21 and 22. When the grip 63 is brought into contact with the bottom of the inlet-side side cover 24, the inlet cover 50-2 is stopped and remains immovable.

In this state, jammed sheets can be removed, for example. Thereafter, the inlet cover 50-2 is moved downward by pushing the grip 63 down. Then, the catch 73 is engaged with the stop 75 which is in pressure contact with the inlet cover 50-2. As shown in FIG. 16, the inlet cover 50-2 is structured such that it shields the upper part of the sheet inlet 28 with the space X kept on the top sheet 32. Thus, the inlet cover 50-2 shields the upper part of the sheet inlet 28, and maintains this state. The inlet cover 50-2 is the same as the inlet cover 50 of the first embodiment, and will not be described here.

In this embodiment, the movable cover 49 of the first embodiment is replaced by a folding cover 49-2, which is similar to the collapsible covers 51*a* and 51*b* of the first embodiment. The folding cover 49-2 can obviate the tray bottom cover 52.

Referring to FIG. 16, one end of the folding cover 49-2 is connected to a shaft 70 extending between the side plates 21 and 22 so as to be rotatable. The other end of the folding cover 49-2 is attached to the shaft 56*b* so as to be rotatable.

When the sheet tray 12 is moved, the shaft 70 remains stationary, but a center shaft 71 and the shaft 56*b* follow the movement of the sheet tray 12. The folding cover 49-2 changes its folded state, and acts like an accordion.

Figure 18:
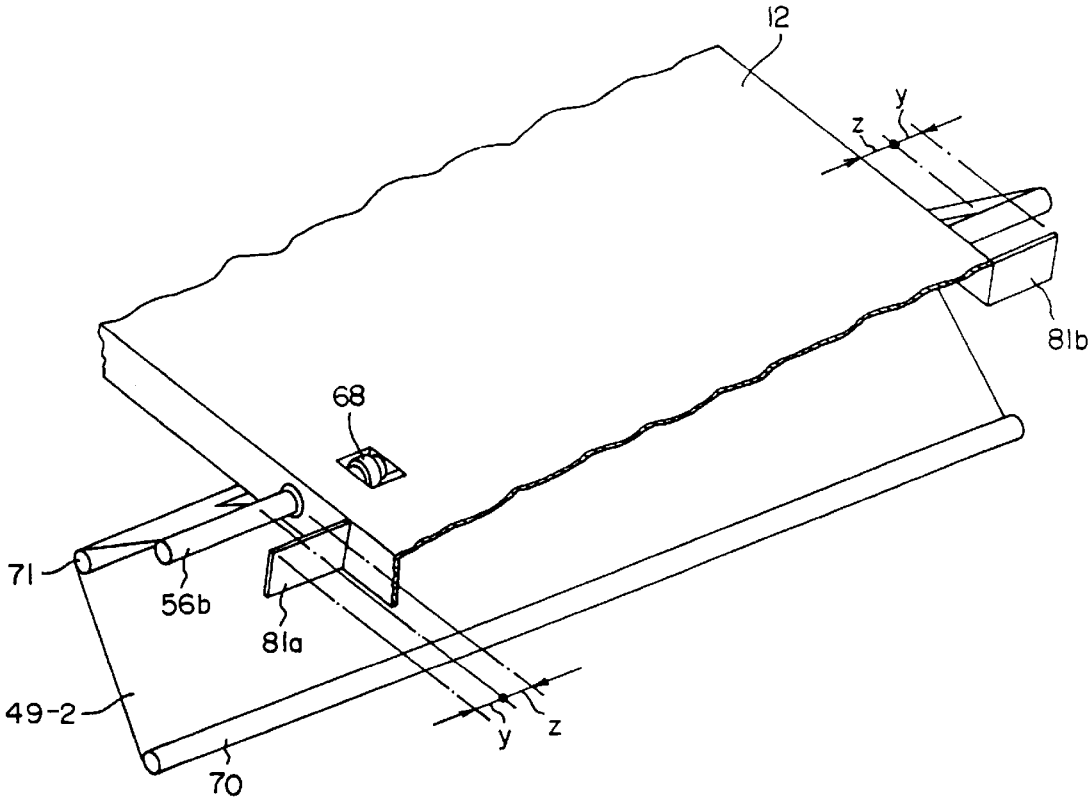
FIG. 18 is a perspective view of the sound reducing unit of FIG. 16.
Figure 19:
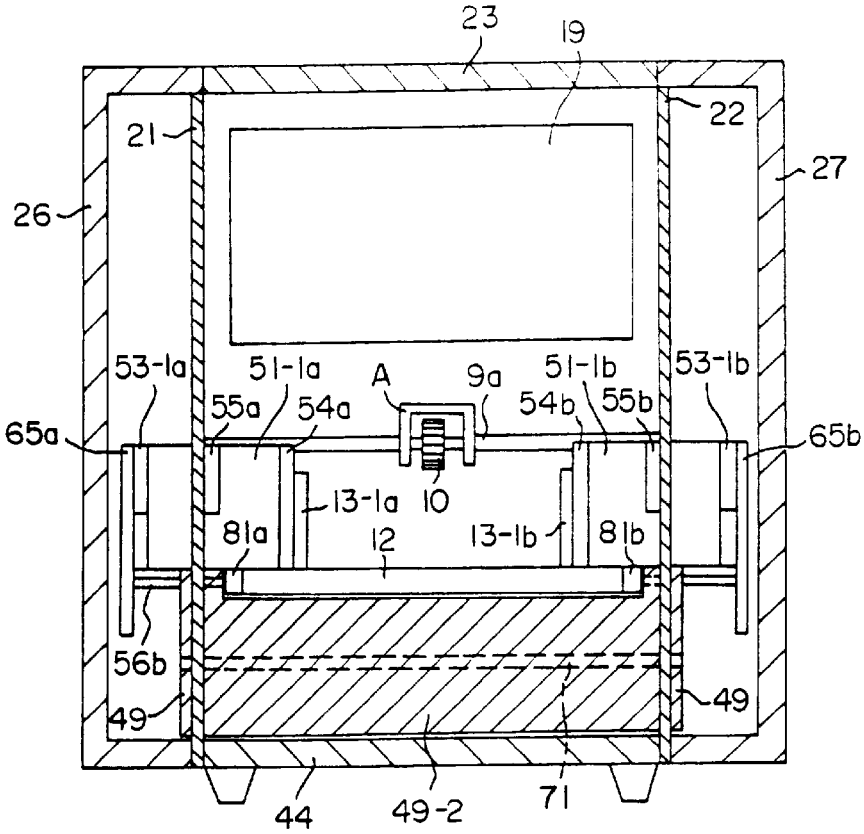
FIG. 19 is a cross section of the printing machine, taken along line L13—L13 in FIG. 16.
Figure 20:
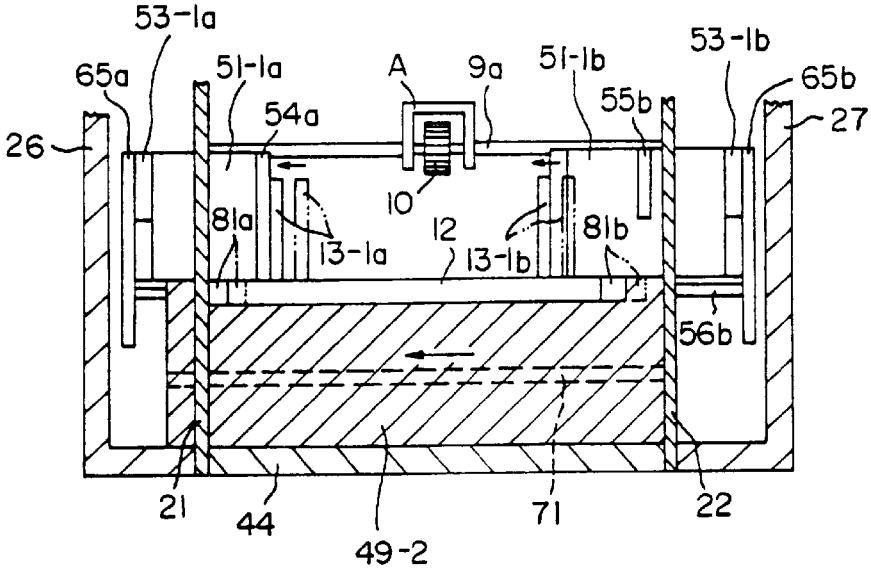
FIG. 20 is a cross section of a part of the printing machine, taken along line L13—L13 in FIG. 16.

This embodiment differs from the first embodiment in that the folding cover 49-2 is disposed between the side plates 21 and 22 without making any openings on the side plates 21 and 22, as shown in FIG. 19. Referring to FIG. 18, the folding cover 49-2 is cut away at two positions by a length Z (=10 mm) near the opposite side edges of the sheet tray 12. Thus, the folding cover 49-2 does not obstruct the sheet tray 12 when it is moved laterally on the shaft 56*b* by 10 mm corresponding to an adjustable margin of the sheet 32.

The cut-away portions of the folding cover 49-2 are shielded by two flaps 81*a* and 81*b* extending from the opposite side edges of the sheet tray 12. The flaps 81*a* and 81*b* are Z (=10 mm) and Y (=10 mm) long as shown in FIG. 18.

The folding cover 49-2 operates similarly to the movable cover 49 in the first embodiment.

The flaps 81*a* and 81*b* are made of a material which is similar to that of the folding cover 49-2 and has the large sound reduction index. To enhance the sound reduction, the flaps 81*a* and 81*b* may be covered by the sound reducing materials 58 and 59 utilized in the first embodiment. In such a case, the flaps 81*a* and 81*b* can shield a space which is made by moving the sheet tray 12 laterally in the direction shown by an arrow in FIG. 20. Further, the flaps 81*a* and 81*b* can also shield a space formed by moving the sheet tray 12 in a direction opposite to the direction shown in FIG. 20.

Figure 21:
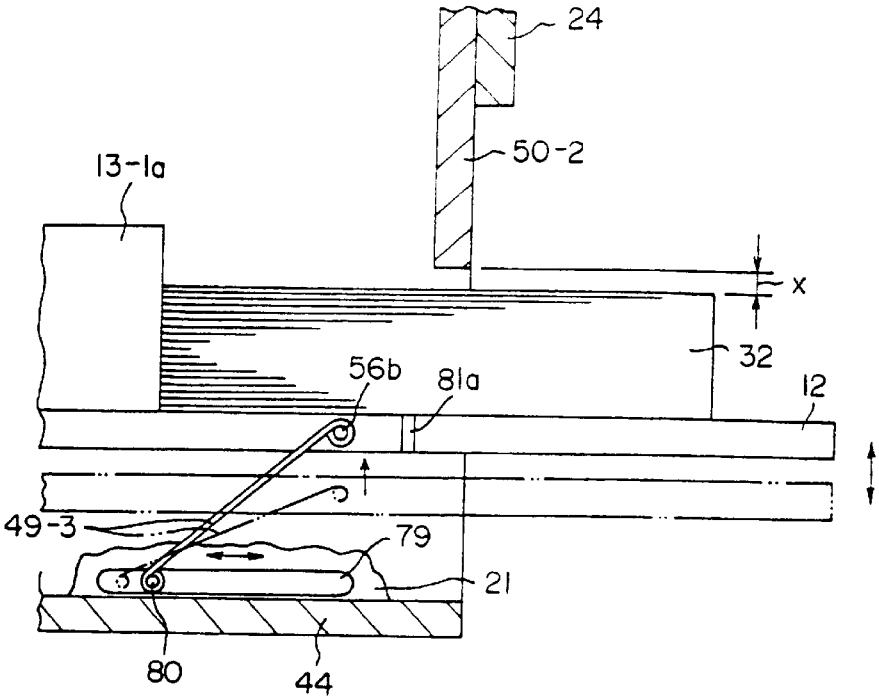
FIG. 21 is a cross section of a sound reducing cover for a sheet feed tray according to the third embodiment.

A sliding cover 49-3 may be used as shown in FIG. 21. The sliding cover 49-3 is rotatably supported by the shaft 56*b* at its top and, at its bottom, to a shaft 80 which is slidable in the elongated openings 79 on the side plates 21 and 22. Thus, the sliding cover 49-3 slides via the shaft 80 at its end in the elongated openings 79 as the sheet tray 12 is moved. In other words, the movable cover 49-3 raises itself as the sheet tray 12 is moved upward, thereby shielding the space under the sheet tray 12. The sliding cover 49-3 is of a similar material to the folding cover 49-2, and is as effective as the folding cover 49-2.

Embodiment 4

Figure 22:
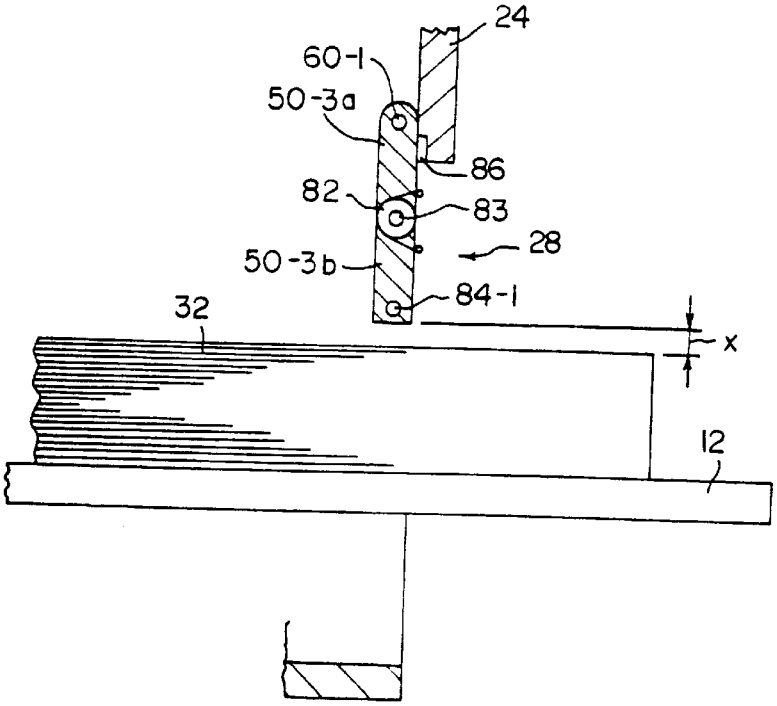
FIG. 22 is a cross section of a sheet inlet cover according to a fourth embodiment.

Referring to FIG. 22, the inlet cover 50-3 has upper and lower pieces 50-3*a* and 50-3*b* which are supported on a center free shaft 83. In other words, the inlet cover 50-3 can be folded via the shaft 83. The upper piece 50-3*a* is supported by a stationary shaft 60-1 so as to be able to turn thereon. The stationary shaft 60-1 extends between the side plates 21 and 22. The lower piece 50-3*b* can turn on a sliding shaft 84-1, which can slide up and down in elongated openings of the side plates 21 and 22. A torsion spring 82 is attached around the center shaft 83, and is hooked to the upper and lower pieces 50-3*a* and 50-3*b*.

Figure 23:
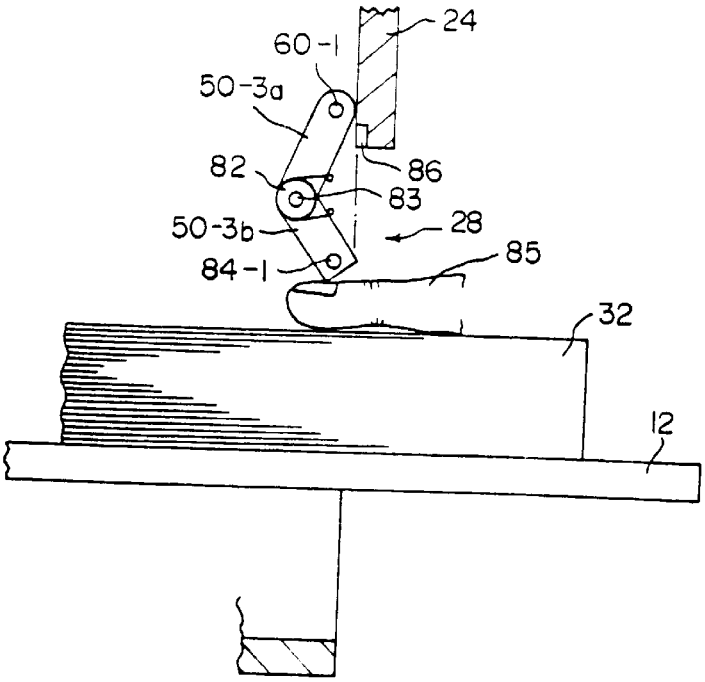
FIG. 23 is a view similar to FIG. 22, but showing the sheet inlet cover in an operated state.

When something enters or is placed in the space above the top sheet 32 on the sheet tray 12, the inlet cover 50-3 is pushed upward and folded on the center shaft 83. The torsion spring 82 urges the upper and lower pieces 50-3*a* and 50-3*b* to return to the original state shown in FIG. 22 from the folded state shown in FIG. 23. However, the torsion spring 82 also enables the inlet cover 50-3 to be folded when it is pushed upward by something present in the space between the top sheet 32 and the inlet cover 50-3.

The inlet cover 50-3 can shield the space above the top sheet 32 with the space X retained. The torsion spring 82 is designed to be operated by a load of 0.98N in this embodiment, and remains inactive even when the lower piece 50-3*b* of the inlet cover 50-3 is pushed or rubbed by a curled or wrinkled sheet 32.

When something such as a finger is caught between the inlet cover 50-3 and the top sheet 32, a microswitch 86 on the inlet-side side cover 24 is turned off. In response to a signal from the microswitch 86, a control unit (not shown) stops the operation of the printing machine. This arrangement can assure safe operation of the printing machine.

Embodiment 5

Figure 24:
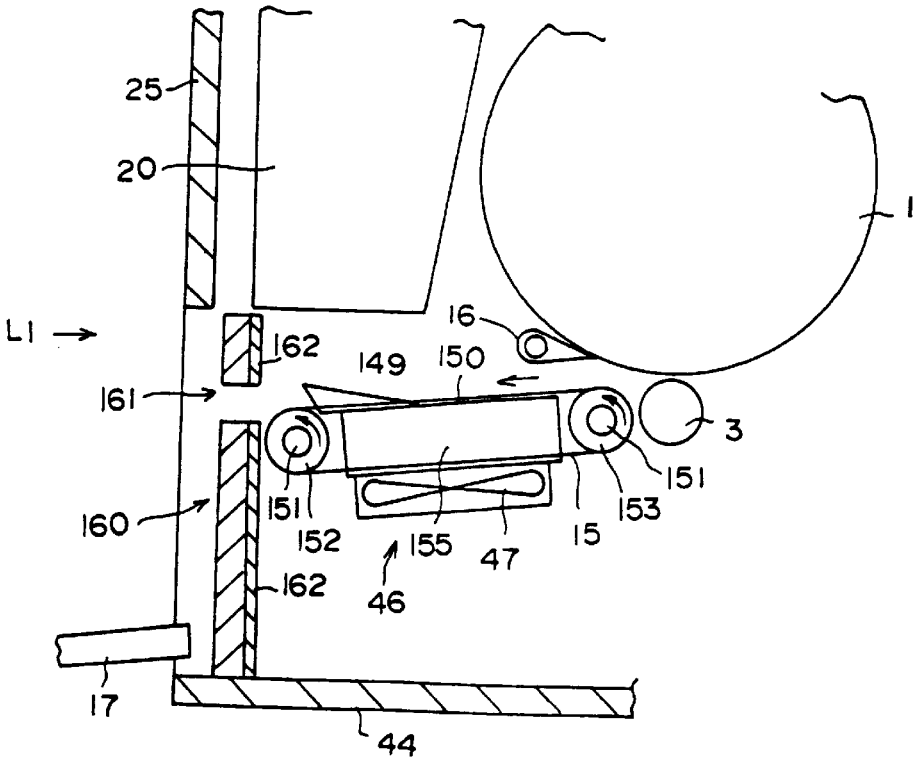
FIG. 24 is a schematic view of a sound reducing unit of a fifth embodiment, showing the sound reducing unit disposed near a sheet outlet of the printing machine.

A fifth embodiment of the invention relates to a sound reducing unit for the sheet outlet of the printing machine. As shown in FIG. 24, the sound reducing unit includes an outlet cover 160 for reducing sound or noise generated around a sheet discharging station 46.

The printed sheet 32 is stripped from the printing drum 1 by the sheet separating claw 16, and is guided onto the sheet discharging station 46, which includes a suction box 155 and the conveyer belt 15. The sheet discharging station 46 conveys the printed sheet 32 to the printed sheet tray 17.

The suction box 155 has a porous flat plate 150 on its top, and has a fan 47 attached on its bottom. The suction box 155 sucks air via the porous flat plate 150, and extends between the printing drum 1 confronting the press roller 3 and the printed sheet tray 17. The suction box 155 is inclined by an angle which is the same as an inclined angle of the printed sheet tray 17. Thus, the printed sheet 32 can be conveyed to the printed sheet tray 17 without changing its inclined posture.

Referring to FIG. 24, the sheet discharging station 46 includes conveyer belt 15, which extends around a pair of pulleys 151 arranged along the sheet feed path. The conveyer belt has a number of pores through which air is sucked in cooperation with the suction box 155.

Further, the sheet discharging station 46 includes a sheet curving mechanism, which curves the sheets 32 in the shape of a reversed arch such that the sheet 32 can be closely attracted onto the conveyer belt 15.

Figure 26:
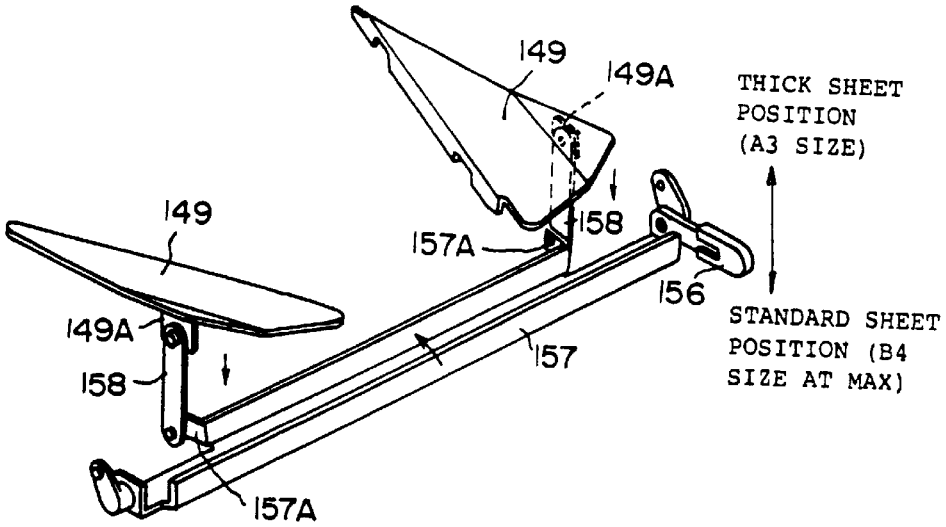
FIG. 26 is a perspective view of a part of a sheet curving mechanism of the suction-type sheet conveying unit.

As shown in FIG. 26, the sheet curving mechanism mainly includes a pair of jump stands 149, a lever 156, a stay 157, and a pair of levers 158. The jump stands 149 can fold the side edges of the sheet 32 by different angles. The jump stands are inclined at their portions confronting the opposite side edges of the sheet 32. Alternatively, the jump stands 149 may be flat so long as they can curve the sheet 32 with a desired angle.

Figure 25:
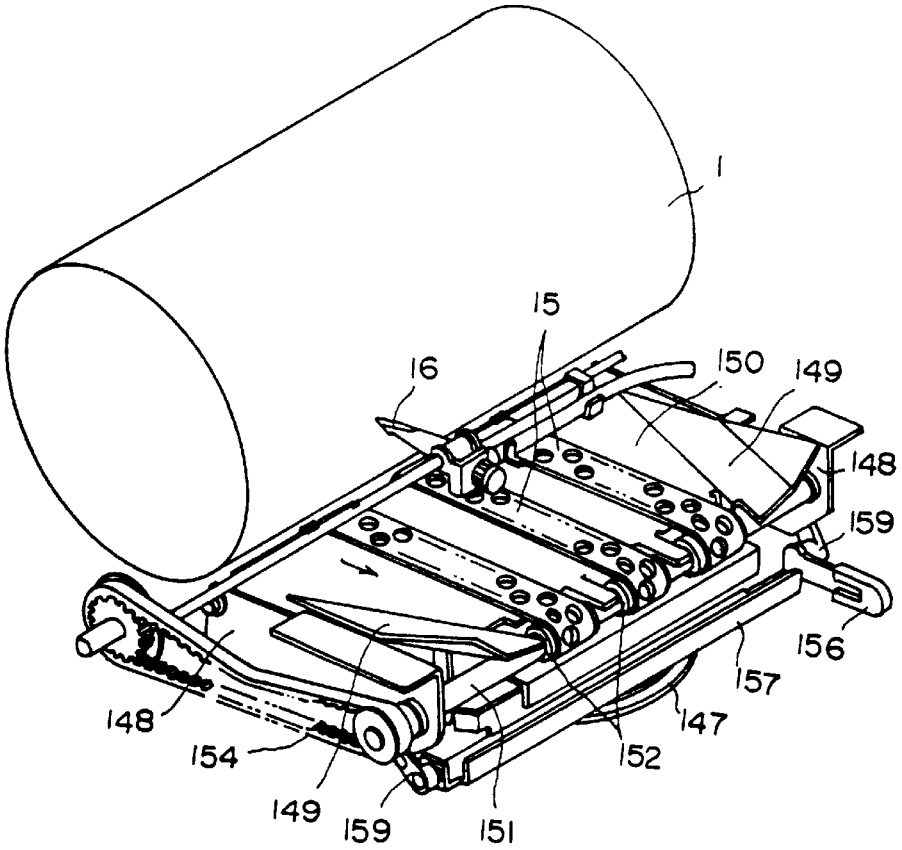
FIG. 25 is a perspective view of a part of a suction-type sheet conveying unit of the printing machine of FIG. 24.

The lever 156 is supported, at its base, by an arm 159 (shown in FIG. 25) fixed to a side plate 148 of the sheet discharging station 46 such that the lever 156 is swingable. The lever 156 swings in accordance with the size and thickness of the sheets 32. In this embodiment, the lever 156 is adjustable to a standard sheet position or a thick sheet position. Specifically, the standard sheet position is for sheets which have a B4 size at maximum and are relatively easy to fold while the thick sheet position is for sheets which have an A3 size and are relatively rigid and thick. Whether or not the sheets are easily folded depends upon their thickness.

The jump stands 149 are structured as shown in FIG. 26, and arranged along the opposite side edges of the sheet 32. The stay 157 extends in a direction orthogonal to the feeding direction of the sheet 32, and has a pair of links 157A extending from the opposite ends thereof. The levers 158 are coupled to the links 157*a*. When the stay 157 is operated due to the swinging of the lever 156, the links 157A also swing. The swinging of the links 157A causes the levers 158 and the links 157A to be moved accordingly.

The levers 158 are linked to brackets 149A integral with the jump stands 149. When the levers 158 are moved, sheet receiving parts of the jump stands 149 are inclined. Thus, the sheet 32 is folded upward in conformity with the inclined opposite side edges of the jump stands 149.

Figure 27:
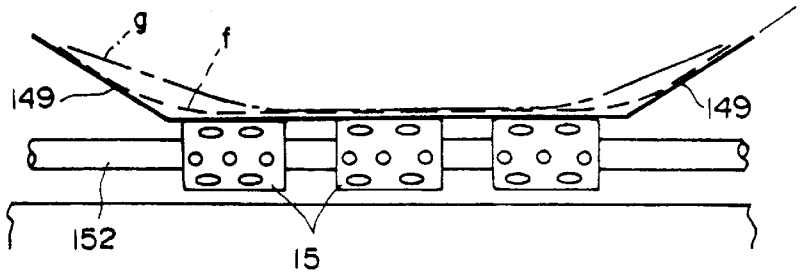
FIG. 27 is a schematic view showing a manner in which a printed sheet is transported by the conveying unit of FIG. 24.
Figure 28:
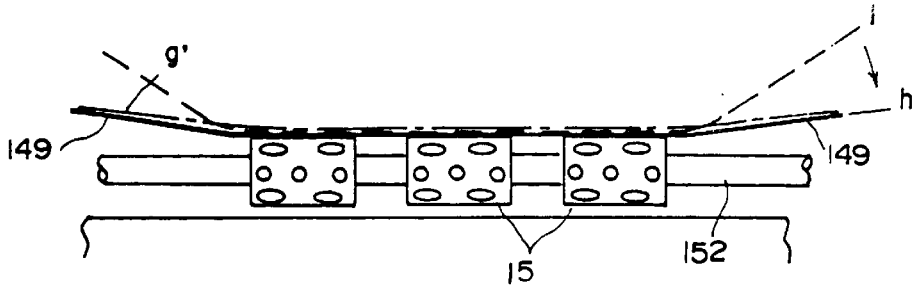
FIG. 28 is a schematic view showing another manner in which a printed sheet is conveyed.

The jump stands 149 are inclined as shown in FIGS. 27 and 28. Specifically, FIG. 27 shows that the lever 156 is set to the standard sheet position. In this state, the lever 158 is pushed upward, and the jump stands 149 are inclined with a large angle. In FIG. 27, letter f denotes the posture of the printed sheet 32 before it arrives at the jump stands 149, and letter g denotes that the opposite edges of the sheet 32 are raised when the standard sheet position is selected. In this state, the printed sheet 32 is in the shape of a reversed arc. This prevents the sheet 32 from being folded in the sheet feeding direction and enables it to keep its rigidity. Therefore, the sheet 32 can land on the printed sheet tray 17 without its leading edge drooping.

FIG. 28 shows that the jump stands 149 are set to the thick sheet position so as to transport large sheets. In this case, the lever 156 is set lower than the standard sheet position. The lever 158 reduces the angle of the jump stands 149 and makes them substantially flat 28. In FIG. 28, letter i denotes the inclined profile of the jump stands 149 for the standard sheet position, and letter h denotes the inclined profile of the jump stands 149 for the thick sheet position. In this state, the sheet 32 has a profile g' which is substantially flat compared to the profile g in FIG. 27. Thus, the sheet 32 can be easily attracted to the suction box 155.

The outlet cover 160 is positioned upstream of the printed sheet tray 17, as shown in FIG. 24. One of the pulleys 152 carrying the conveyer belt 15 thereon is present near the outlet cover 160.

The outlet cover 160 extends longitudinally between the bottom of the stencil take-up station 20 and the bottom cover 44 of the printing machine, and laterally between the side plates 21 and 22 (shown in FIG. 3). The outlet cover 160 is a flat plate, and is detachably screwed to the bottom cover 44 and the side plates 21 and 22.

Further, the outlet cover 160 is made from a transparent acrylic material as in the first embodiment, and has a sound reducing member 162 bonded onto its surface confronting the sheet discharging station 46, except for at a window for detecting jammed sheets. The sound reducing member 162 is made of a foaming urethane-group material such as 10–20-mm thick VD FOAM (trade name, produced by Bridgestone Co., Ltd.). Further, the sound reducing member 162 is covered by a 2-mm thick LR DAMPER (trade name, produced by Bridgestone Co., Ltd.).

Figure 29:
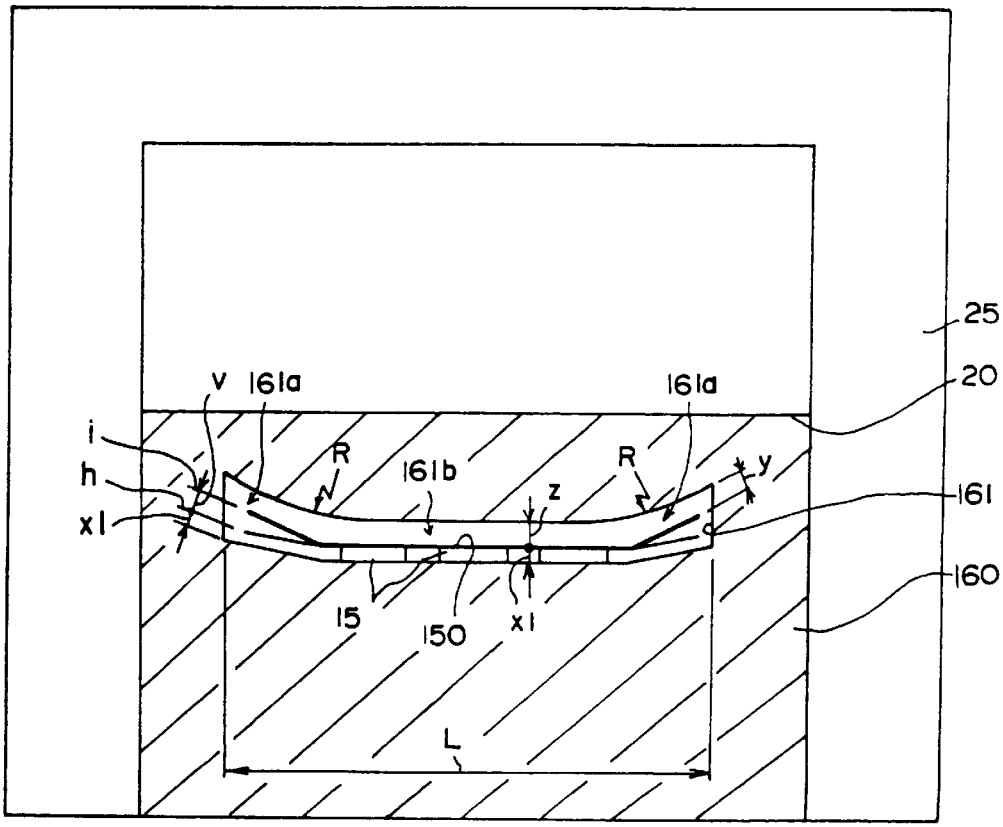
FIG. 29 is a schematic view of the sound reducing unit, viewed in the direction L1 in FIG. 24.

Referring to FIG. 29, the outlet cover 160 has its own sheet outlet 161 which is shaped such that the sheet 32 can be discharged therethrough without any problem regardless of the inclined angle of the jump stands 149.

In FIG. 29, the sheet outlet 161 is roughly divided into two side portions 161*a* and a center portion 161*b*. Reference numeral x1 denotes a distance between the porous flat plate 150 of the suction box 155 and a lower edge of the sheet outlet 161 at its center portion 161*b*. The distance x1 is 1 mm to 3 mm in this embodiment. Letter z denotes a distance between an upper edge of the sheet outlet 161 and the top plate 150, and is 7 mm to 10 mm. Letter y denotes a distance between the jump stands 149 and an upper edge of the sheet outlet 161 (of the outlet cover 160) when the jump stands 149 are set to the standard sheet position. The upper edge of the sheet outlet 161 is curved by a radius of curvature of 150 mm to 180 mm near the portions 161*a*. Letter L denotes a width of the sheet outlet 161, which is 305 mm to 310 mm such that sheets 32 of the maximum size (A3 size) can reliably pass through. Further, letter v denotes a difference between angles of the jump stands 149 at the standard sheet position and the thick sheet position.

The sheet outlet 161 has a minimum size which enables one sheet 32 of any size (A3 size at maximum) to pass therethrough at a time without any problem. Therefore, it is possible to reduce sound, such as a striking sound of the press roller 3 or a hissing air sound from the sheet separating claw, which leaks from the interior of the printing machine.

The inventor measured noise levels of the printing machine, and obtained the results which are the same as those shown in Table 1.

As can be seen from Table 1, the sound reducing unit of the fifth embodiment can reduce the noise level by 2 to 6 dB(A) compared with a printing machine which has no sound reducing apparatus. The unit dB(A) represents a level of sound or noise which is measured using the A-characteristic frequency filter according to the ISO or JIS standard.

Embodiment 6

Figure 30:
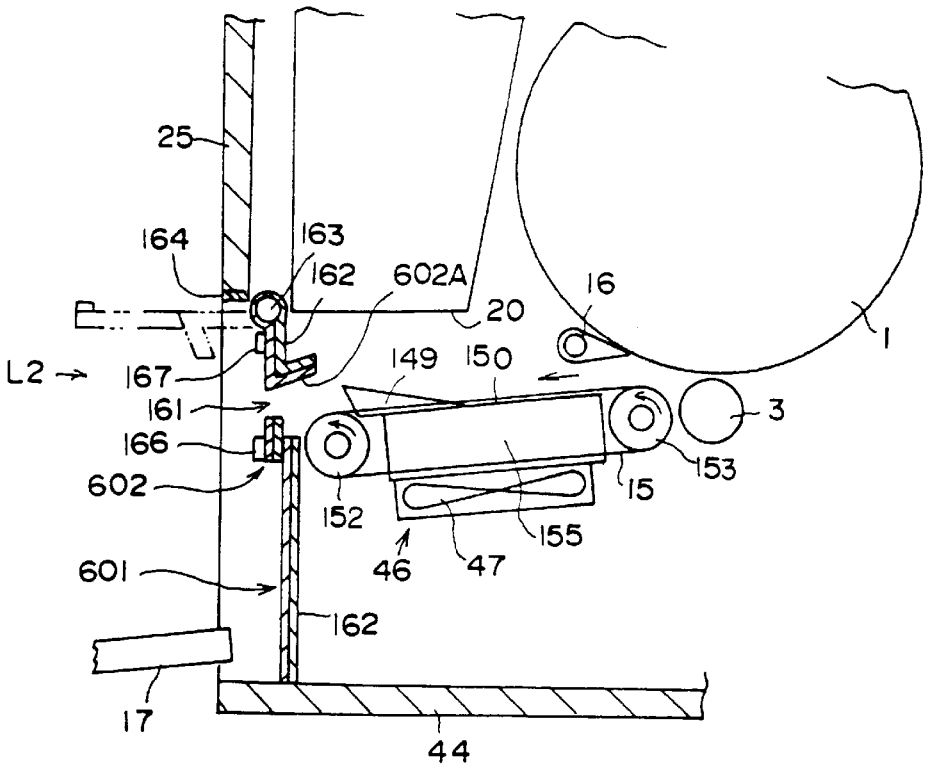
FIG. 30 is a schematic view showing a sound reducing unit according to a sixth embodiment attached near a sheet outlet of the printing machine.
Figure 31:
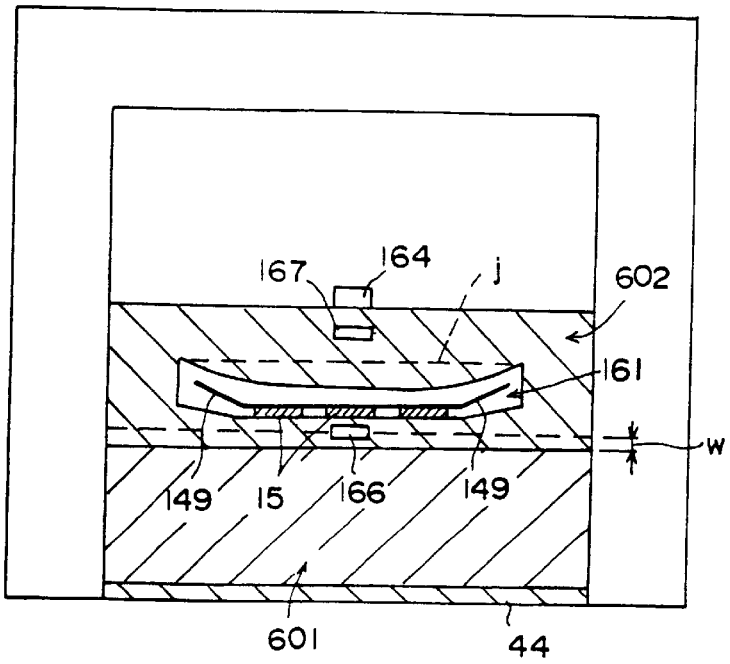
FIG. 31 is a schematic view of the printing machine, viewed in the direction shown by arrow L2 in FIG. 30.

FIGS. 30 and 31 show an outlet cover 160 according to a sixth embodiment of the invention. The outlet cover 160 includes upper and lower members 602 and 601. The upper member 602 extends from the bottom of the stencil take-up station 20 and to an area near the upper part of the lower member 601, and between the side plates 21 and 22. The lower member 601 extends between an area confronting the pulley 152 of the sheet discharging station 46 and the bottom cover 44. The upper member 602 overlaps, at its bottom, with the top of the lower member 601 by a distance w (=20 to 80 mm) as shown in FIG. 31.

The lower member 601 is made of a steel plate having a large sound reduction index, and is detachably screwed to the bottom cover 44.

The upper member 602 is made from the same material as that of the outlet cover 160 in the fifth embodiment. The upper member 602 is supported by a rotatable shaft 163, is swingable thereon, and has the sheet outlet 161 as in the fifth embodiment. The sheet outlet 161 is present near the overlapping area of the upper and lower members 602 and 601. The upper member 602 has a portion 602A near the sheet outlet 161, which is folded toward the sheet discharging station 46 such that a space above the sheet discharging station 46 is tapered in the sheet feeding direction. Therefore, even if the printed sheet 32 is curved or wrinkled, it is reliably guided along the folded portion 602A toward the sheet outlet 161.

The printed sheet 32 may become curved or wrinkled due to the ink used for the printing. The printing machine uses emulsion type ink in which water tends to evaporate at different rates from the sheet 32. In such a case, the sheet 32 is not dried uniformly. This would make the sheet curved or wrinkled.

As shown in FIG. 30, the upper member 602 has a magnet receiver 167 near its base. The magnet receiver 167 is magnetically attracted to a magnet 164 attached onto the outlet-side side cover 25 of the printing machine. Further, a grip 166 is attached on the outer surface of the upper member 602. The upper and lower members 602 and 601 are covered by a sound reducing member 162 and a vibration damping material.

In FIG. 31, letter j denotes an edge of the folded portion 602 A of the upper member 602. The folded portion 602A has a bottom curved in accordance with the shape of the sheet outlet 161.

When discharging the sheets 32 onto the printed sheet tray 17, the upper member 602 remains overlapping with the lower member 601 as shown by a solid line in FIG. 30. Thus, the sheet 32 conveyed by the sheet discharging station 46 is guided along the folded portion 602A of the upper member 602, and is discharged onto the printed sheet tray 17.

When removing jammed sheets or performing maintenance work, the upper member 602 is pulled using the grip 166, and is kept at the position shown by a dashed line by the magnet receiver 167 being attracted to the magnet 164. Thus, there is a vacant space above the sheet discharging station 46. The jammed sheets can be removed via this space.

In this embodiment, the outlet cover 160 is partially opened and closed, which facilitates the removal of jammed sheets or maintenance work. When the outlet cover 160 is closed, there is a minimum open portion thereon so as to reduce or suppress sound or noise leaking from the printing machine. The outlet cover 160 is as effective as the outlet cover of the fifth embodiment as shown in Table 2. Further, the outlet cover 160 can reduce a sound level by 2 to 6 dB(A) compared with a conventional printing machine without any sound reducing apparatus.

The outlet cover 160 is disposed inside the printing machine and can reliably reduce or suppress sound or noise, so that no additional sound reducing apparatus is necessary outside the printing machine.

Embodiment 7

Figure 32:
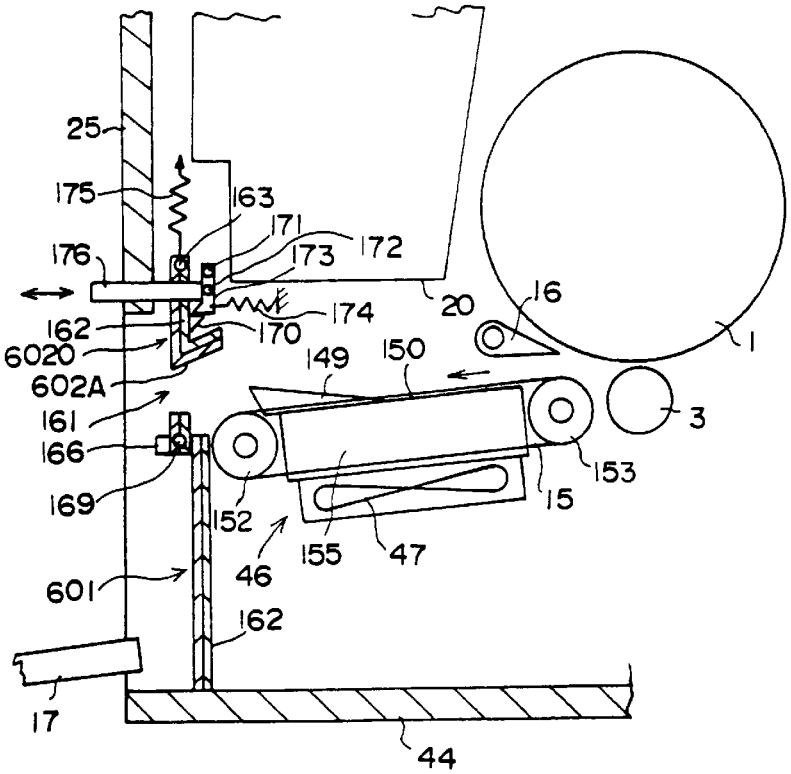
FIG. 32 is a schematic view showing a sound reducing unit according to a seventh embodiment attached near the sheet outlet of the printing machine.
Figure 33:
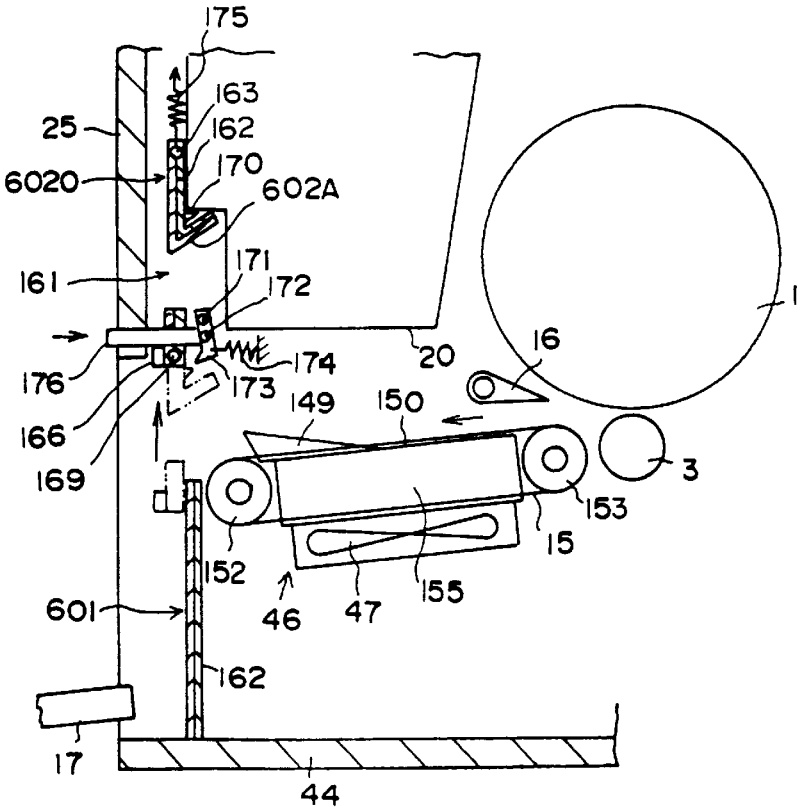
FIG. 33 is view similar to FIG. 32, but showing an operated state of the sound reducing unit.

A seventh embodiment differs from the sixth embodiment in that an upper member 6020 is longitudinally movable as shown in FIGS. 32 and 33 while the upper member 602 of the sixth embodiment is swingable.

Referring to FIG. 32, the upper member 6020 is coupled, at its top, to a tension spring 175 which is connected to an immovable member of the printing machine body. The upper member 6020 is urged to move upward by the tension spring 175, and includes slidable shafts 163 and 169 at positions somewhat apart from the opposite ends of the sheet outlet 161. The slidable shafts 163 and 169 are guided in a longitudinal elongated opening of the printing machine.

The upper member 6020 has a catch 170 near the sheet outlet 161. The catch 170 is engageable with a stop 173. The stop 173 is a swingable lever having a shaft 171 at one end, and is coupled to a compression spring 174 at the other end. The stop 173 is usually urged toward the catch 170 of the upper member 6020. Further, the stop 173 is coupled, at its center, to a rod 176 via a shaft 172. The rod 176 projects outward from the printing machine body. The upper member 6020 has a grip 166 at its bottom. When the rod 176 is pushed toward the interior of the printing machine, the stop 173 is made to turn counterclockwise, disengaging the catch 170 from itself. Thereafter, the upper member 6020 is moved upward by the tension spring 175 as shown in FIG. 33.

The upper member 602 has a grip 166 similar to the grip of the sixth embodiment.

To discharge the printed sheet 32, the upper and lower members 6020 and 601 are in the state as shown in FIG. 32, i.e. these members 602 and 601 overlap, and the catch 170 of the upper member 6020 remains engaged with the stop 173.

The rod 176 is pushed inward when opening the upper member 6020 to make a vacant space downstream of the sheet discharging station 46. Specifically, when the rod 176 is pushed, the stop 173 turns counterclockwise, and disengages itself from the catch 170. Then, the upper member 6020 is moved upward until the folded portion 602A reaches the bottom of the stencil take-up station 20, thereby forming the vacant space around the sheet discharging station 46.

When closed, the upper member 6020 of the outlet cover 160 can prevent sound or noise from leaking from the printing machine. Conversely, the opened upper member 6020 facilitates the removal of jammed sheets 32 or maintenance work of the printing machine. Further, since the upper member 6020 is movable upward in the printing machine body without any swing motion, no additional space is necessary for opening the upper member 6020. Only a few members project from the printing machine body so that a user can operate or maintain the printing machine without being obstructed.

The sound reducing unit of this embodiment is shaped so as to reduce sound or noise leaking from the printing machine regardless of the posture of the printed sheets to be discharged. It is possible to reduce sound or noise without unnecessarily enlarging a space where the printing machine is installed.

Embodiment 8

An outlet cover of this embodiment includes upper and lower members similarly to those of the sixth and seventh embodiments. However, the upper member 603 is positioned above the top plate 150 of the suction box 155.

Figure 34:
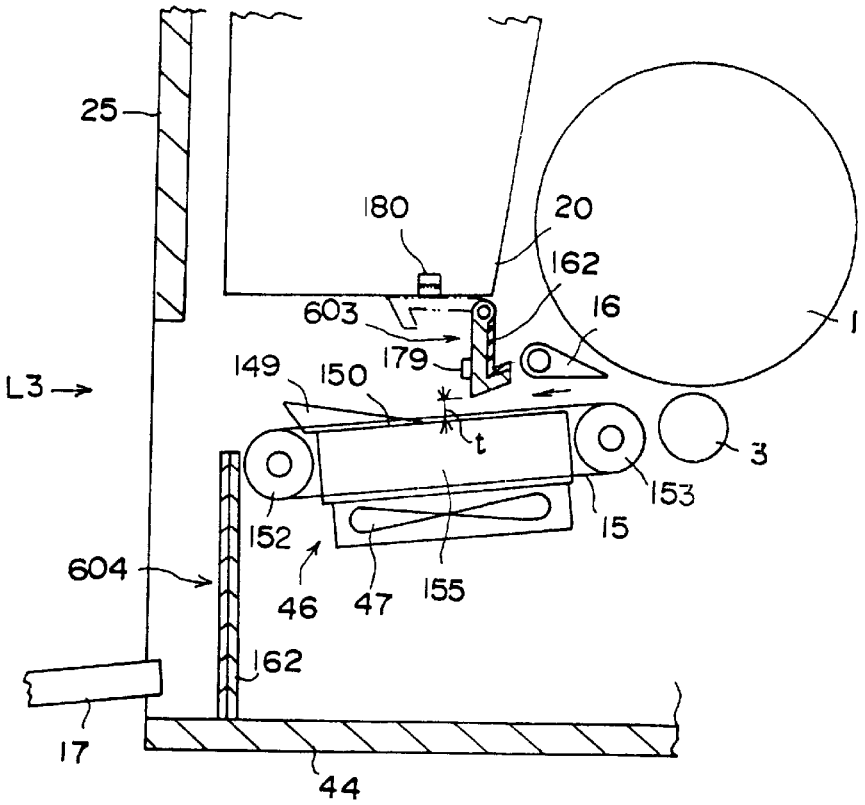
FIG. 34 is a schematic view showing a sound reducing unit according to an eighth embodiment attached near the sheet outlet of the printing machine.

Referring to FIG. 34, the upper member 603 shields the space above the conveyer belt 15 except for the space t. The space t allows curled or wrinkled sheets 32 to pass therethrough, and is 2 mm to 5 mm in this embodiment.

The upper member 603 does not have its own sheet outlet contrary to the upper members of the sixth and seventh embodiments. The sheet 32 passes through the space, the height and width of which are t and M (i.e. the width of the maximum sheet 32 of A3 size, and 305 mm to 310 mm in this embodiment).

Figure 35:
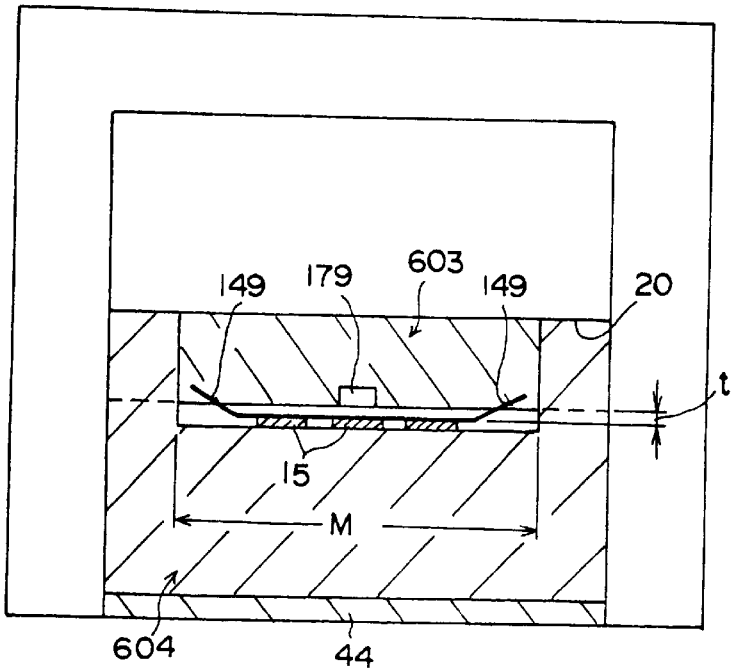
FIG. 35 is a schematic view of the printing machine, viewed in the direction as shown by arrow L3 in FIG. 34.
Figure 36:
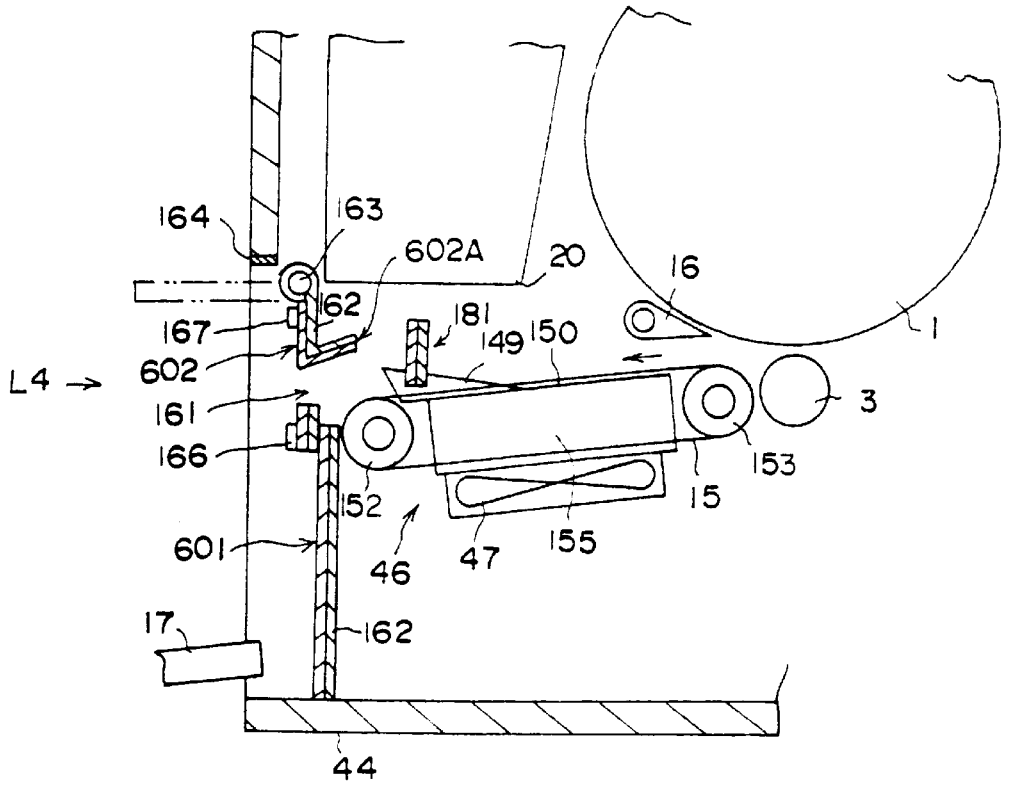
FIG. 36 is a perspective view of a sound reducing unit according to a ninth embodiment, attached near the sheet outlet of the printing machine.

The upper member 603 swings between two positions, one is the position which is above the conveyer belt 15 by the distance t and the other is on the bottom of the stencil take-up station 20. The upper member 603 may be folded at its bottom similarly to the upper member of the seventh embodiment, as shown in FIG. 35. In such a case, the sheet 32 is guided by the folded end of the upper member 603 toward the printed sheet tray 17.

The upper member 603 has a magnet receiver 179 which also serves as a grip. The magnetic receiver 179 is engageable with a magnet 180 on the bottom of the stencil take-up station 20. When the magnetic receiver 179 is attracted to the magnet 180, a vacant space is made over the conveyer belt 15. When the upper member 603 is displaced as shown by a dashed line in FIG. 34 so as to be opened, it is brought into contact with the bottom of the stencil take-up station 20 via the magnet receiver 179 (also functioning as a grip) and the magnet 180 on the stencil take-up station 20. When the magnet receiver 179 is disengaged from the magnet 180, the upper member 603 is returned to the position confronting the sheet discharging station 46.

In this embodiment, the lower member 604 is positioned downstream of the sheet discharging station 46 and near the printed sheet tray 17.

Referring to FIG. 35, the lower member 604 has a recess on its upper edge. The recess is 1 mm to 3 mm deep below a prolongation of the top plate 150 of the sheet discharging station 46, and 305 mm to 310 mm wide (width M shown in FIG. 35).

The upper and lower members 603 and 604 are made of a material similar to those of the upper and lower members in the sixth and seventh embodiments, and are covered, on their surfaces confronting the printing drum 1, by a sound reducing/vibration damping material 162.

The lower member 604 is positioned 1 mm to 3 mm below the prolongation of the top plate 150 on the sheet discharging station 46, and has a recess whose size is M (=305 to 310 mm wide) and through which A-3 size sheets can pass. The lower member 604 is also covered by the sound reducing/vibration damping material 162 on its surface confronting the sheet discharging station 46.

In this embodiment, the lower edge of the upper member 603 can be brought very close to the space above the conveyer belt 15. Further, the upper edge of the lower member 604 can be brought very close to the prolongation of the conveyer belt 15. Therefore, only the opening necessary for passing the sheet 32 can be obtained, which can reduce sound or noise leaking from the printing machine.

Embodiment 9

Figure 37:
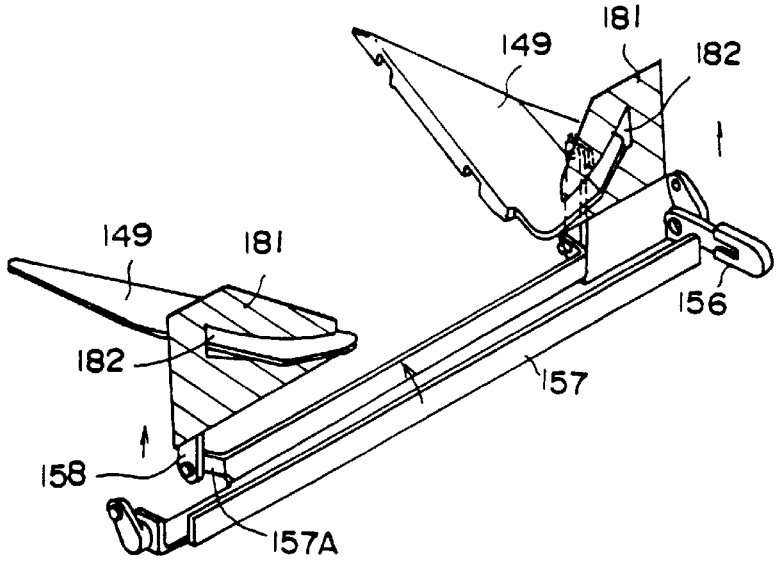
FIG. 37 is a perspective view of a part of a sheet folding mechanism of the suction-type conveying unit shown in FIG. 36.

A sound reducing unit of a ninth embodiment will be described with reference to FIGS. 36 to 39. The sound reducing unit includes upper and lower members 602 and 601, which are the same as those of the sixth embodiment, and a pair of members 181 are used for the jump stands 149. The jump stands 149 are inclined as shown in FIG. 37. Each of the members 181 has a slit 182 into which each jump stand 149 is inserted.

Figure 38:
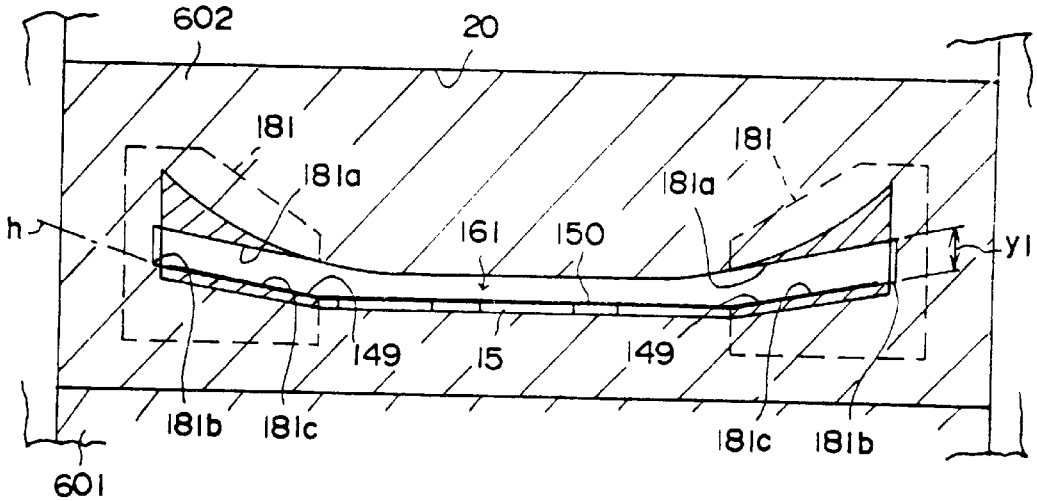
FIG. 38 is a schematic view showing the shape of a sheet outlet, in one mode, on a sound reducing cover.

In FIG. 38, "y1" denotes a distance between each jump stand 149 and an upper edge 181*a* of the slit 182, and is 5 mm to 7 mm in this embodiment. The slits 182 are shaped according to an angle by which the jump stands are inclined.

Lower edges of the slits 182 are parallel to the jump stands 149.

Referring to FIG. 38, the sheet outlet 161 of the upper member 602 has a width for enabling the A3-size sheets to pass without any problem.

The members 181 are movable with the jump stands 149.

The slits 182 change their posture together with the inclination of the jump stands 149. FIG. 38 shows that the jump stands 149 are adjusted to the thick sheet position. In this case, the members 181 are lowered together with the jump stands 149 (shown by letter h), as shown by dashed lines in FIG. 38. Thus, the members 181 shield the upper part of the sheet outlet 161 of the upper member 602.

Figure 39:
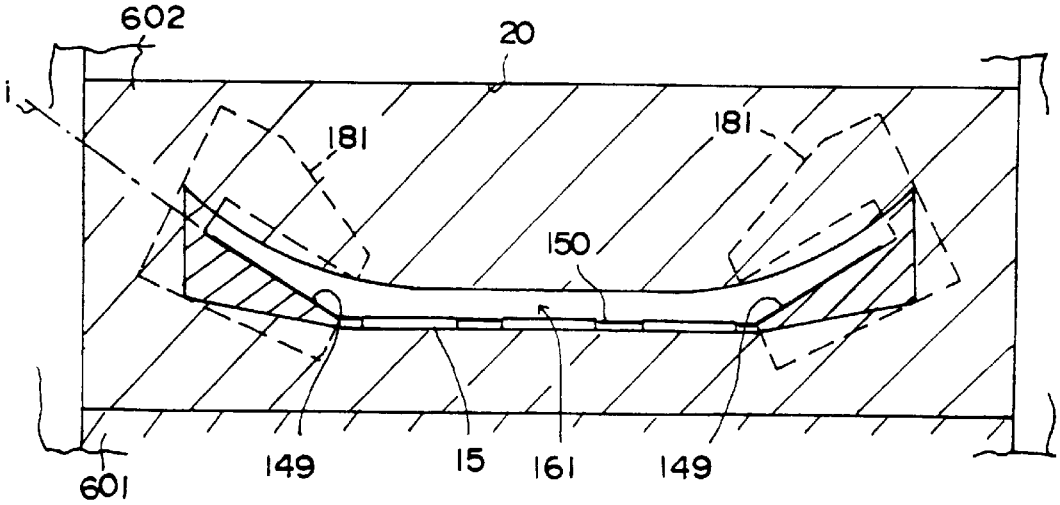
FIG. 39 is a schematic view showing the shape of the sheet outlet, in another mode, on the sound reducing cover.

FIG. 39 shows that the jump stands 149 are adjusted to the standard sheet position. In the case of the standard sheet position, the members 181 are raised together with the jump stands 149 (shown by letter i). In this state, the members 181 shield the space between the lower edge of the sheet outlet 161 and the under side of the jump stands 149.

Embodiment 10

Figure 40:
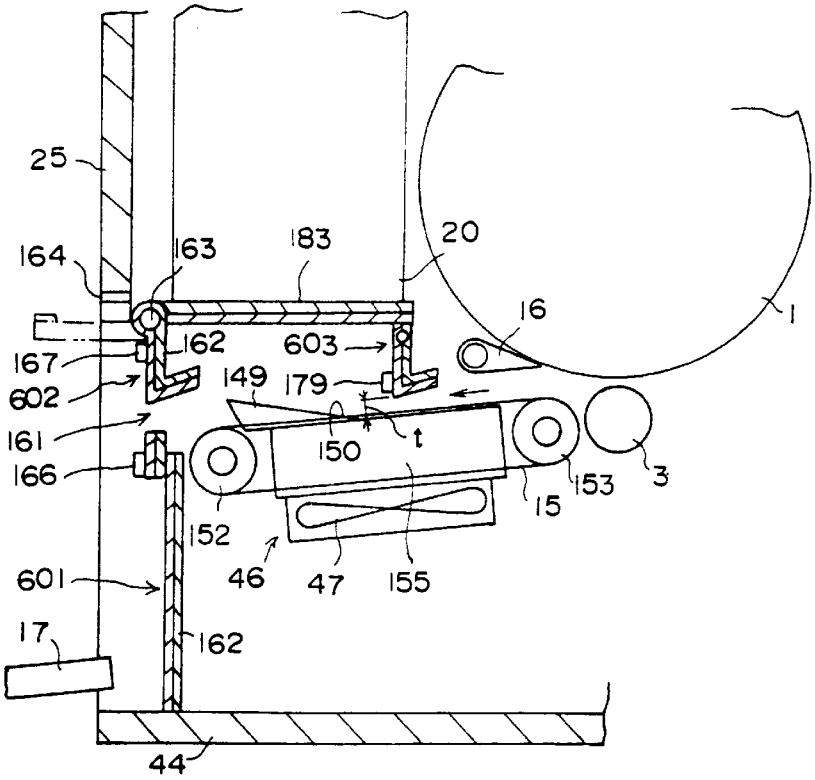
FIG. 40 is a perspective view of a sound reducing unit according to a tenth embodiment, attached near the sheet outlet of the printing machine.
Figure 41:
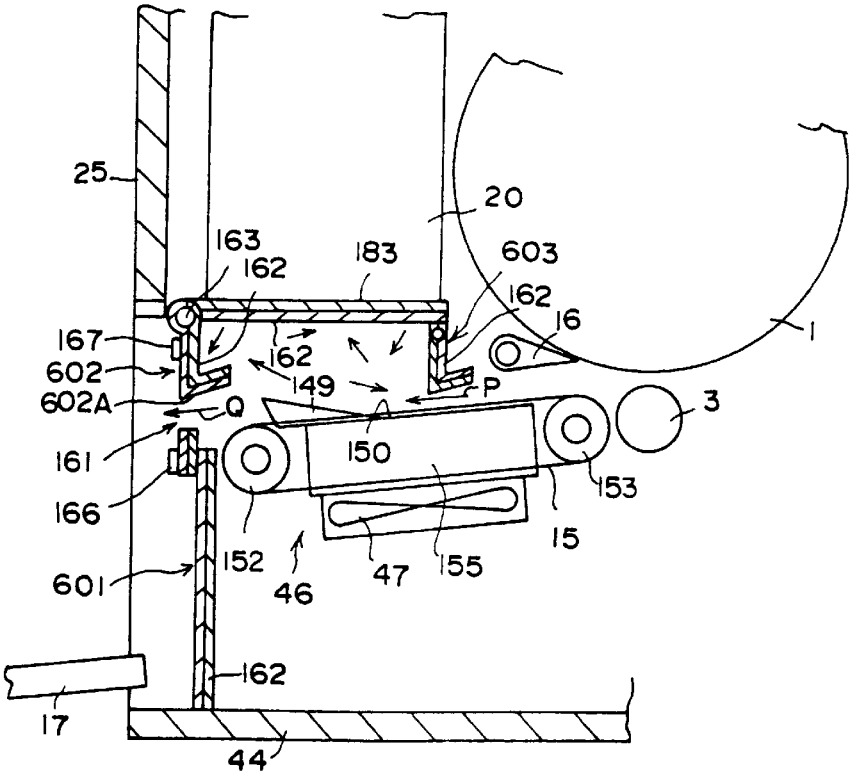
FIG. 41 is a schematic view showing how sonic waves are received in the sound reducing unit of FIG. 41.

Referring to FIGS. 40 and 41, an outlet cover of this embodiment includes a plurality of members, i.e. a combination of the upper and lower members 602 and 601 of the sixth embodiment, the upper member 603 of the eighth embodiment, and a member 183 for coupling the upper members 601 and 603 (member 183 is called "coupling member 183"). The upper members 602 and 603 are respectively called "first upper member 602" and "second upper member 603" hereinafter. A space is defined above the sheet discharging station 46 by the first upper member 602, the coupling member 183 and the second upper member 603.

The second upper member 603 is made of transparent acrylic resin such that jammed sheets 32 in the sheet feed path can be detected therethrough. The second upper member 603 is covered with the sound reducing/vibration damping material 162 on its surface confronting the printing drum 1. The bottom of the second upper member 603 is present with a gap t kept above the upper surface of the conveyer belt 15 as with the upper cover 603 of the eighth embodiment. This gap t enables curled or wrinkled sheets to pass therethrough.

The space defined by the first and second upper members 602, 603 and the coupling member 183 (i.e. sound reducing space) is effective in receiving sound waves via an entrance (having a height t) between the sheet discharging station 46 and the second upper member 603, irregularly reflecting the sonic waves therein, causing them to mutually interfere and attenuate. FIG. 41 shows the foregoing state. The sound waves (shown by arrows) having a volume P advance into the sound reducing space, are reflected, caused to interfere and attenuate therein, and are absorbed by the sound reducing member 602A. Some of the sound waves leak via a space above the top plate 150 of the sheet discharging station 46, and have a volume Q. The volume P is larger than the volume Q. The outlet cover including two upper members is more effective in reducing sound or noise than the outlet cover having one upper member in each of the foregoing embodiment.

The inventor compared the sound reducing units in the fifth and tenth embodiments, and measured sound levels reduced by those sound reducing units and sound levels in a printing machine without any sound reducing unit. Table 3 shows the results of the measurement. As can be seen from Table 3, the sound reducing unit of the tenth embodiment can reduce the sound level by 3 to 7 dB(A) compared with the printing machine without the sound reducing unit. Further, the sound reducing unit of the tenth embodiment effectively reduces the sound level by 1 to 3 dB(A) compared with the sound reducing unit of the sixth embodiment.

TABLE 2

Unit: dB(A)

| | Measured Positions | | | |
|---|---|---|---|---|
| | Front side of machine | Rear side of machine | Feed side | Discharge side |
| Printing machine without sound reducing apparatus | 62.8 | 62.1 | 67.3 | 66.7 |
| Printing machine with sound reducing unit of 5th embodiment | 59.7 | 60.2 | 61.3 | 63.4 |
| Printing machine with sound reducing unit of l0th embodiment | 58.9 | 59.0 | 60.4 | 60.7 |

It is possible to dispose the sound reducing units both at the sheet feeding station and the sheet discharging station.

It should be understood that various modifications can be made to the preferred embodiments disclosed herein without departing from the spirit and scope of the invention or without the loss of its attendant advantages. Thus, other examples applying the principles described herein are intended to fall within the scope of the invention provided the features stated in any the following claims or the equivalent of such be employed. For instance, the invention is also applicable to electrostatic copying machines or printers.

What is claimed is:

1. A printing machine having a body, comprising:

a) a sheet feeding station for feeding sheets into a printing station, said sheet feeding station including an inlet-side side cover having an opening therein defining a sheet inlet;

b) a sheet discharging station for discharging printed sheets from the printing station and positioned near a sheet outlet;

c) a sound reducing cover disposed near the sheet inlet and shielding the sheet inlet except for a sheet passing area thereof;

wherein the sheet feeding station includes a sheet tray which is inserted in the sheet inlet so as to be vertically movable in a direction orthogonal to a sheet feeding direction; and wherein the sound reducing cover is attached to the inlet-side side cover and extending downwardly therefrom into said sheet inlet so as to be disposed above the sheet tray for shielding a space above a top sheet on the sheet tray with a space of 2–5 mm maintained between the top sheet and the sound reducing cover.

2. A printing machine as recited in claim 1, wherein said sheet feeding station includes a pair of slidable side plates which hold opposite side edges of sheets on the sheet tray, and wherein said sound reducing cover is disposed between said inlet-side side cover and said pair of slidable side plates with respect to said width direction of sheets.

3. A printing machine having a body, comprising:

a) a sheeting feeding station for feeding sheets into a printing station, said sheet feeding station including an inlet-side side cover having an opening therein defining a sheet inlet;

b) a sheet discharging station for discharging printed sheets from the printing station and positioned near a sheet outlet;

c) a sound reducing cover disposed near the sheet inlet and shielding the sheet inlet except for a sheet passing area thereof;

wherein the sheet feeding station includes a sheet tray which is inserted in the sheet inlet so as to be vertically movable in a direction orthogonal to a sheet feeding direction; and wherein the sound reducing cover is attached to the inlet-side side cover and extending downwardly therefrom into said sheet inlet so as to be disposed above the sheet tray for shielding a space above a top sheet on the sheet tray with a space of 2–5 mm maintained between the top sheet and the sound reducing cover;

wherein the sound reducing cover includes means for allowing the sound reducing cover to be opened and closed.

4. A printing machine comprising:

a) a sheet feeding station for feeding sheets into a printing station and being attached in a sheet inlet;

b) a sheet discharging station for discharging printed sheets from the printing station and positioned near a sheet outlet;

c) a sound reducing cover disposed near at least one of the sheet inlet and the sheet outlet and shielding at least one of the sheet inlet and the sheet outlet except for a sheet passing area thereof;

wherein the sheet feeding station includes a sheet tray which is inserted in the sheet inlet so as to be vertically movable in a direction orthogonal to a sheet feeding direction; and wherein the sheet feeding station includes a lower sound reducing cover for shielding a space under the sheet tray, and further wherein said lower sound reducing cover is mounted such that at least a portion of said lower sound reducing cover is moveable in response to the movement of the sheet tray.

5. The printing machine according to claim 4, wherein the sheet tray is inserted in the sheet inlet so as to be movable in a width direction of sheets, and the lower sound reducing cover is coupled to the sheet tray and is movable with the sheet tray.

6. A printing machine comprising:

a) a sheet feeding station for feeding sheets into a printing station and being attached in a sheet inlet;

b) a sheet discharging station for discharging printed sheets from the printing station and positioned near a sheet outlet;

c) a sound reducing cover disposed near at least one of the sheet inlet and the sheet outlet and shielding at least one of the sheet inlet and the sheet outlet except for a sheet passing area thereof;

wherein the sheet feeding station includes a sheet tray which is inserted in the sheet inlet so as to be vertically movable in a direction orthogonal to a sheet feeding direction; and wherein the sheet tray includes a pair of slidable side plates which hold opposite side edges of sheets on the sheet tray and are movable in a width direction of sheets in accordance with the size of sheets; and further wherein the sheet feeding station includes a pair of side sound reducing covers for shielding spaces outside the slidable side plates and wherein at least part of said pair of side sound reducing covers is mounted so as to be movable in response to the movement of the slidable side plates.

7. The printing machine according to claim 6, wherein the sheet tray is inserted in the sheet inlet so as to be movable in a width direction of sheets, and the side sound reducing covers are coupled to the sheet tray and are slidable with the sheet tray.

8. A printing machine as recited in claim 1, wherein said sound reducing cover is disposed between said inlet-side side-cover and said pair of slidable slide plates with respect to said width direction of sheets.

* * * * *

UNITED STATES PATENT AND TRADEMARK OFFICE

CERTIFICATE OF CORRECTION

PATENT NO. : 5,970,866
DATED : October 26, 1999
INVENTOR(S) : Eiji Okawa

It is certified that error appears in the above-identified patent and that said Letters Patent is hereby corrected as shown below:

Column 1,
Line 20, change "Asheet" to --A sheet--.

Column 24,
Lines 41-44, change "A printing machine as recited in Claim 1, wherein said sound reducing cover is disposed between said inlet-side side-cover and said pair of slidable slide plates with respect to said width direction of sheets." to --A printing machine having a body, comprising:

a) a sheet feeding station for feeding sheets into a printing station and including a vertically movable sheet tray, which includes a pair of slidable plates which hold opposite side edges of sheets on the sheet tray and are movable in a width direction of sheets in accordance with the size of sheets, mounted in a sheet inlet, wherein an inlet-side cover is disposed on said printing machine and has a first opening through which said sheet tray is inserted, with said first opening defining said sheet inlet;

b) a sheet discharging station for discharging printed sheets from the printing station and positioned near a sheet outlet, wherein an outlet-side cover is disposed on said printing machine and has a second opening through which the printed sheets are discharged, with said second opening defining said sheet outlet; and c) a sound reducing cover attached to the body of the printing machine so as to be disposed near at leat one of said first and second openings and so as to shield

UNITED STATES PATENT AND TRADEMARK OFFICE

CERTIFICATE OF CORRECTION

PATENT NO. : 5,970,866
DATED : October 26, 1999
INVENTOR(S) : Eiji Okawa

It is certified that error appears in the above-identified patent and that said Letters Patent is hereby corrected as shown below:

at least one of the sheet inlet and the sheet outlet except for a sheet passing area thereof wherein said sound reducing cover is disposed between said inlet-side side-cover and said pair of slidable slide plates with respect to said width direction of sheets.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*